US005319233A

United States Patent [19]

Kane

[11] Patent Number: 5,319,233

[45] Date of Patent: Jun. 7, 1994

[54] FIELD EMISSION DEVICE EMPLOYING A LAYER OF SINGLE-CRYSTAL SILICON

[75] Inventor: Robert C. Kane, Scottsdale, Ariz.

[73] Assignee: Motorola, Inc., Schaumburg, Ill.

[21] Appl. No.: 882,227

[22] Filed: May 13, 1992

[51] Int. Cl.[5] ..... H01J 1/46

[52] U.S. Cl. ..... 257/350; 257/577; 313/308; 313/309

[58] Field of Search ..... 313/308, 309, 336, 351; 445/24, 50; 257/350, 352, 524, 525, 577, 526

[56] References Cited

U.S. PATENT DOCUMENTS

| | | | |
|---|---|---|---|
| 3,895,392 | 7/1975 | Polata et al. | 257/525 |
| 5,012,153 | 4/1991 | Atkinson et al. | 313/309 |
| 5,090,932 | 2/1992 | Dieumegard et al. | 445/24 |
| 5,142,184 | 8/1992 | Kane | 313/309 |
| 5,148,078 | 9/1992 | Kane | 313/308 |
| 5,155,420 | 10/1992 | Smith | 313/309 |
| 5,188,977 | 2/1993 | Stengl et al. | 445/50 |

OTHER PUBLICATIONS

Sze, *Semiconductor Devices: Physic and Technology*, 1985, pp. 328–329.

*Primary Examiner*—Jerome Jackson
*Assistant Examiner*—Courtney A. Bowers
*Attorney, Agent, or Firm*—Eugene A. Parsons

[57] ABSTRACT

A variety of field emission devices and structures which employ non-substrate layers of single-crystal silicon. By employing non-substrate layers of single-crystal silicon, improved emission control is achieved and improved performance controlling devices are formed within the device structure.

4 Claims, 23 Drawing Sheets

FIELD EMISSION DEVICE EMPLOYING A LAYER OF SINGLE-CRYSTAL SILICON

TECHNICAL FIELD

This invention relates generally to cold-cathode field-emission devices and more particularly to cold-cathode field-emission devices formed on surfaces other than the surface of a supporting substrate layer.

BACKGROUND OF THE INVENTION

Cold-cathode field-emission devices (FEDs) are known in the art. Such cold-cathode field-emission devices employ emitter electrodes with geometric discontinuities of small radius of curvature for the purpose of emitting electrons.

The prior art teaches that FEDs are formed by a number of preferred methods. One such method taught by the prior art results in an emitter electrode disposed on the surface of a supporting substrate material, while an alternative method employs selective semiconductor processing to form the emitter electrode directly from the supporting substrate material.

A number of impediments to optimum utilization of FEDs can be associated with these and other prior art methods. One such impediment is that control of limitation of emission is not easily implemented within the FED structure. Additionally, under prior art methods, mono-crystal silicon transistor devices are generally restricted to formation in the substrate material in a structure in which FEDs are also located.

Therefore, a need exists for an FED formation methodology that can easily incorporate an emitter current limitation mechanism and provide for the formation of single-crystal silicon transistors at locations other than in the substrate material.

SUMMARY OF THE INVENTION

These needs and others are substantially met through provision of the FED formation methodology disclosed herein. A field emission device is provided that comprises a substrate, an insulator layer disposed on a surface of the substrate, a layer of single-crystal silicon disposed on a surface of the insulator layer, and an emitter disposed on a surface of the layer of single crystal silicon.

In one embodiment of the invention, as described above, an emitter electrode(s) is(are) disposed on a surface of a layer of single-crystal silicon.

In another embodiment of the invention, a gate electrode(s) is(are) formed by selective impurity doping of a layer of single-crystal silicon.

In yet another embodiment, a conductive gate material is disposed on a surface of a layer of single-crystal silicon.

In still another embodiment of the invention, a layer of single-crystal silicon is selectively patterned to limit the FED emission.

In a further embodiment, a layer of single-crystal silicon is selectively doped with impurities.

And in yet an additional embodiment of the invention, a transistor device is formed in a layer of single-crystal silicon.

DETAILED DESCRIPTION OF THE DRAWINGS

Figure 1A:
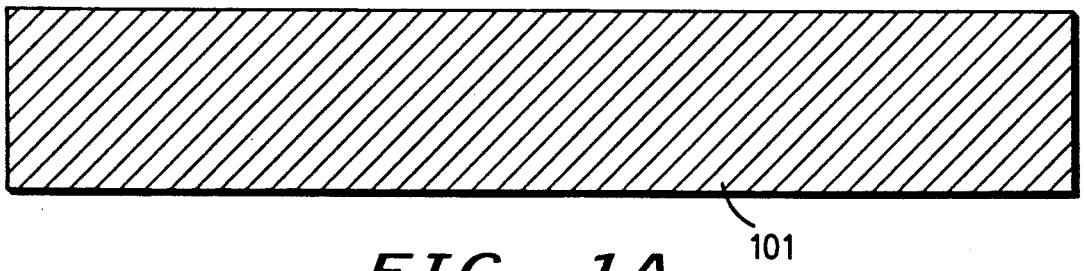
FIGS. 1A–1L are a series of cross sectional depictions of structures resulting from steps that yield an embodiment of the invention.
Figure 1B:
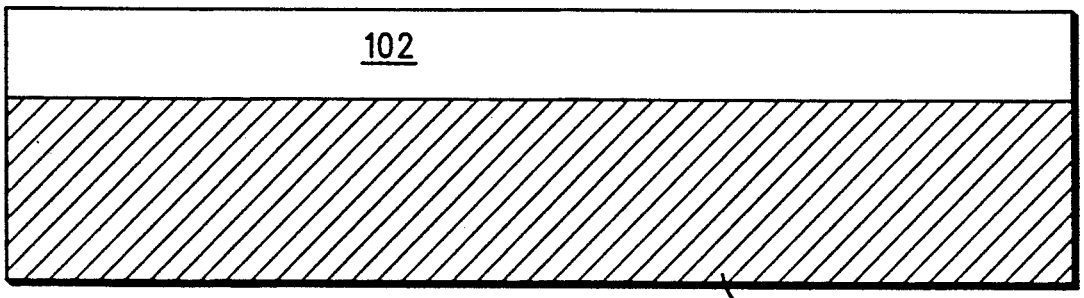
Figure 1C:
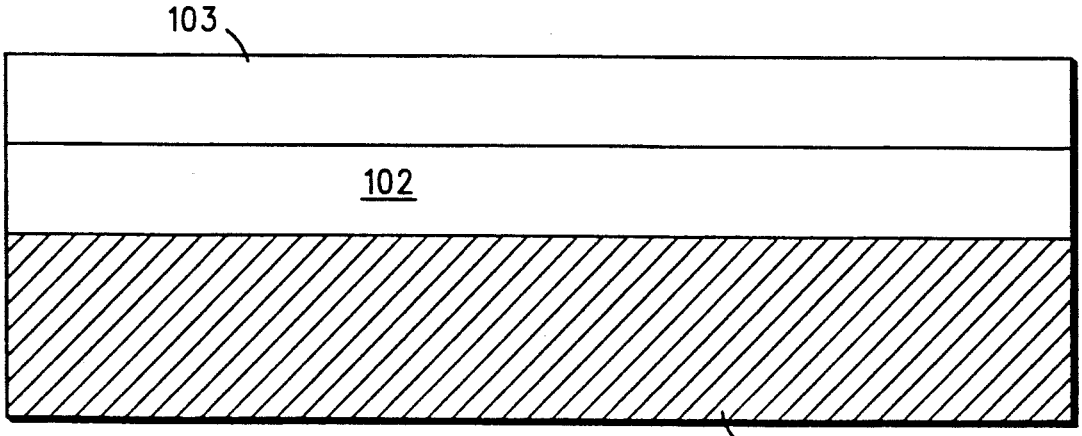
Figure 1D:
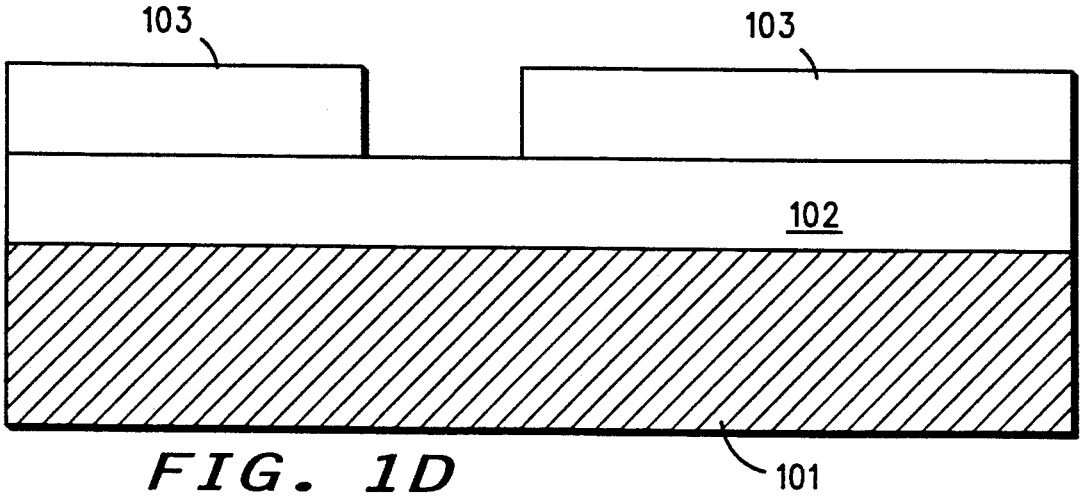
Figure 1E:
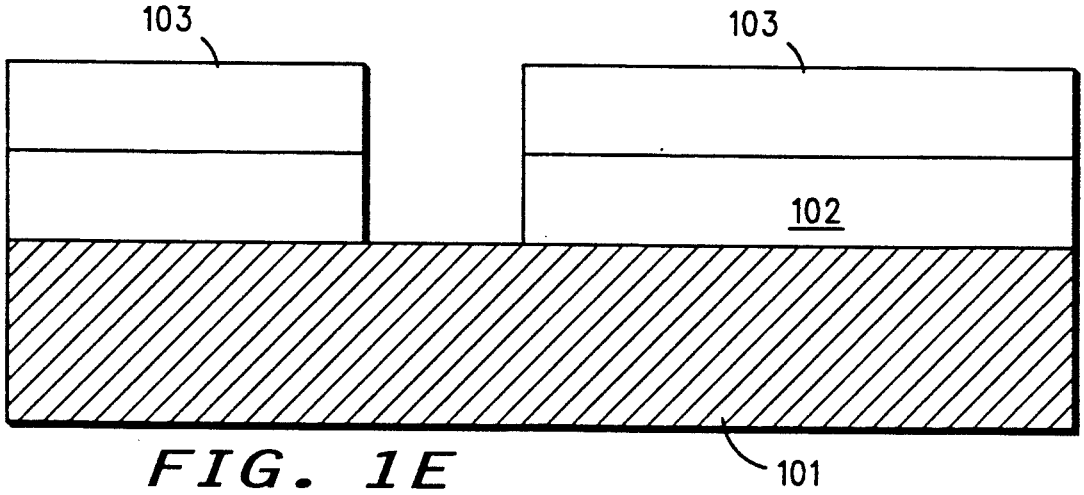
Figure 1F:
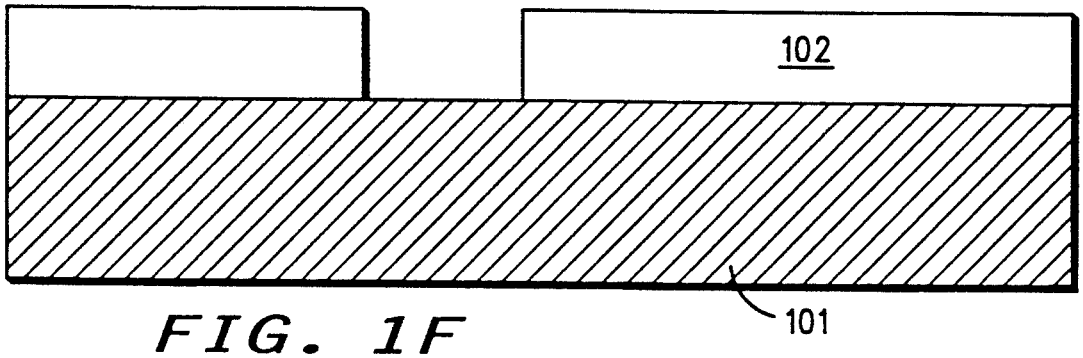

FIG. 1A depicts a substrate 101 which forms the support base on which a field emission device will be formed. A first insulator layer 102 is thermally grown or deposited onto the surface of substrate 101 (FIG. 1B). This is followed by deposition of a mask layer 103 (FIG. 1C). Mask layer 103 is selectively exposed, developed, and patterned to provide openings which expose a surface of underlying insulator layer 102 (FIG. 1D). An insulator etch is performed to selectively remove insulator material from first insulator layer 102 at the areas of first insulator layer 102 exposed by the patterning of mask layer 103 to the extent that a part of the surface of underlying substrate 101 becomes exposed (FIG. 1E). This is followed by removal of mask layer 103 (FIG. 1F).

Figure 1G:
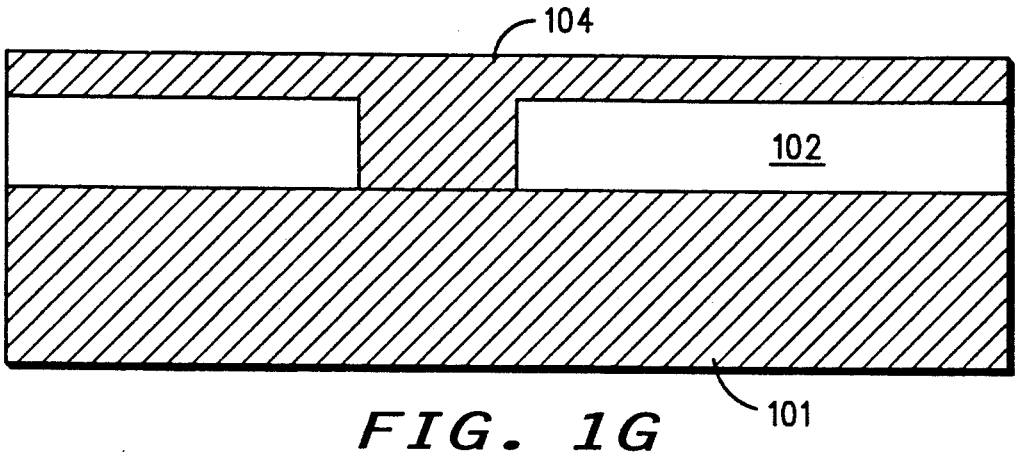
Figure 1H:
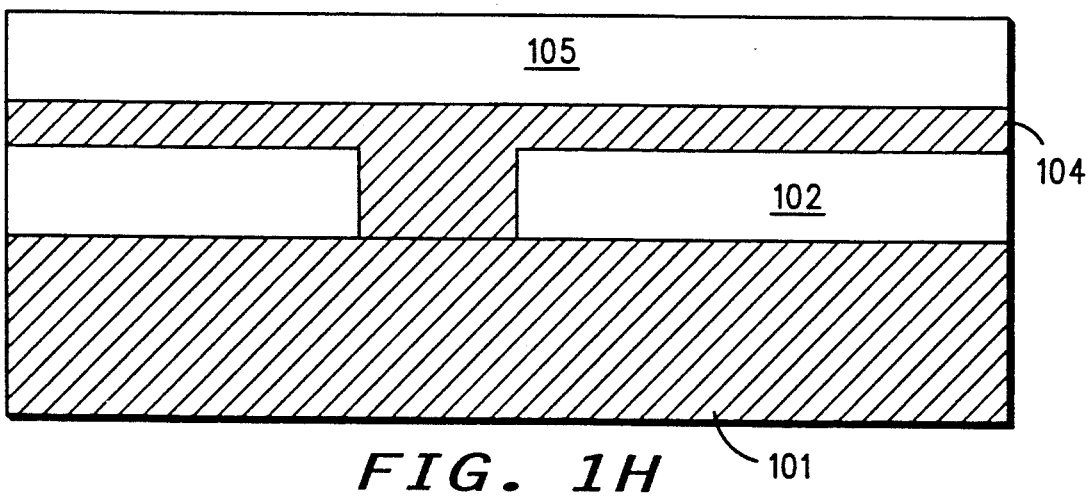
Figure 1I:
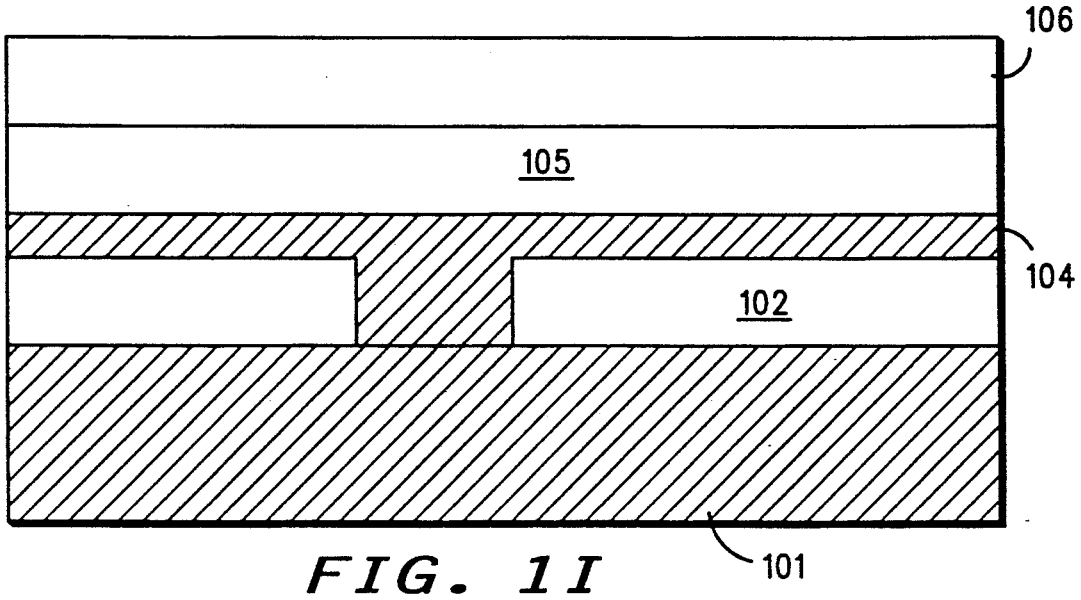
Figure 1J:
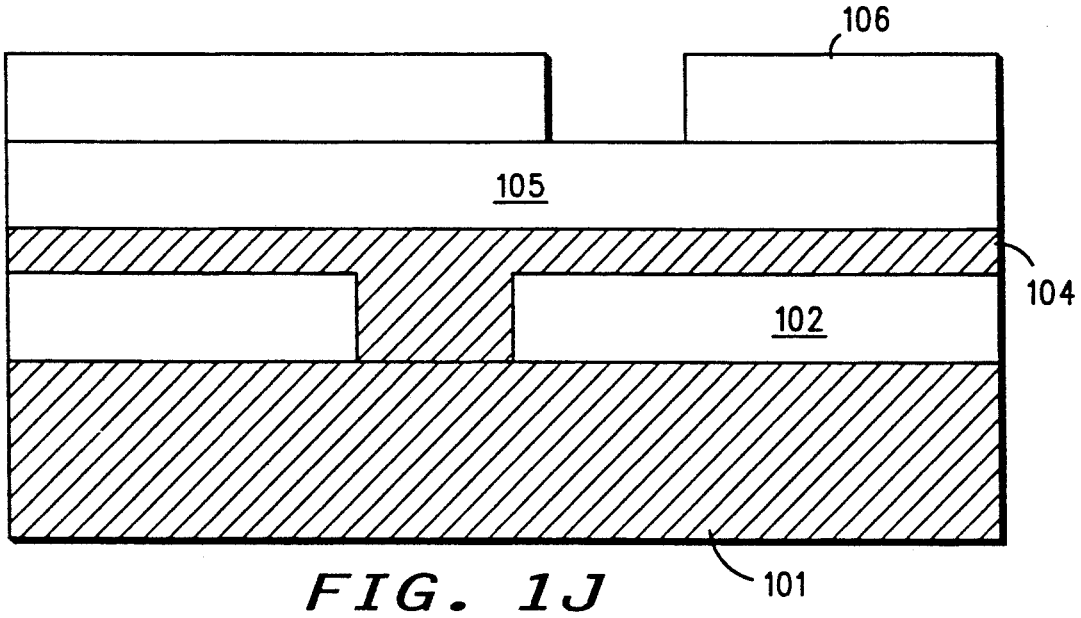
Figure 1K:
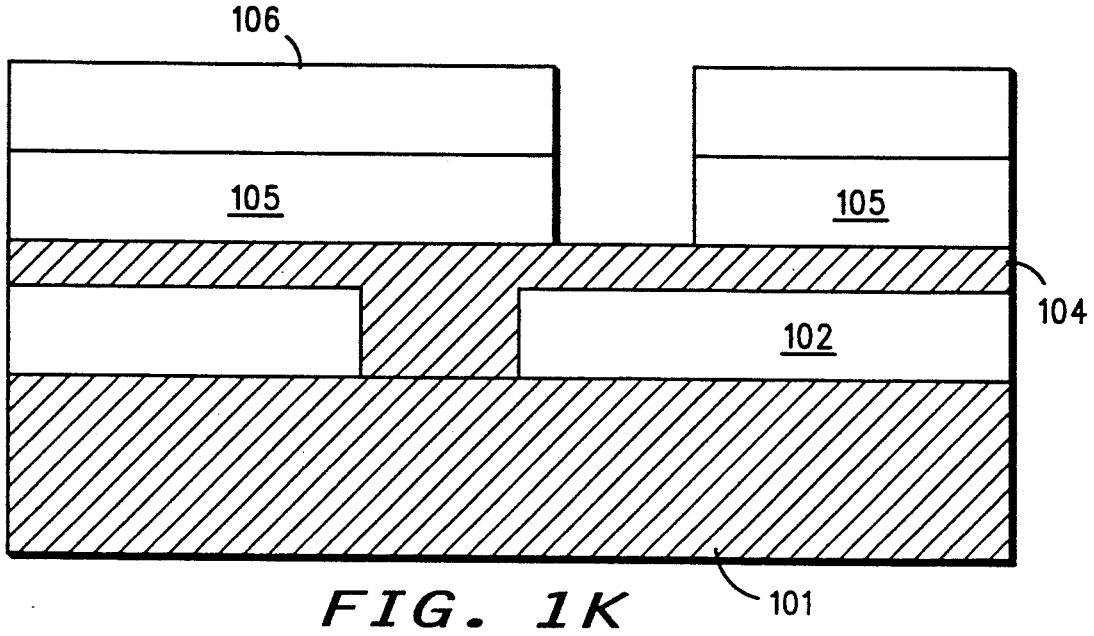
Figure 1L:
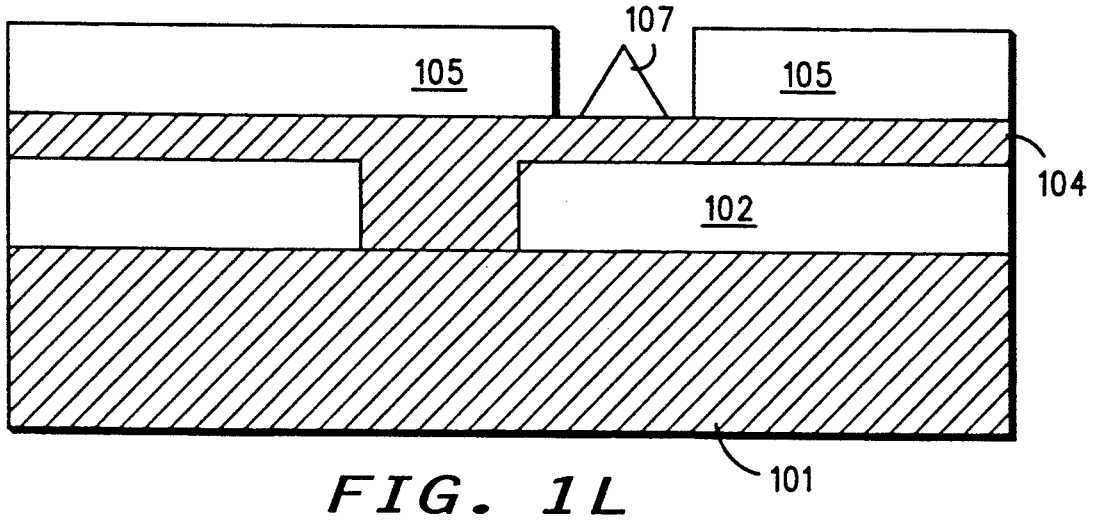

The structure so formed is placed in an environment which readily precipitates silicon preferentially onto the exposed parts of the surface of substrate 101 and continues to precipitate silicon preferentially so as to build-up a layer 104 of single-crystal silicon (FIG. 1G). Such an environment typically contains, in part, silane or disilane gas. Layer 104 of single-crystal silicon is typically grown in this manner to a thickness on the order of 1 μm. Following the growth of layer 104 of single-crystal silicon a second insulator layer 105 is disposed onto a surface of layer 104 of single-crystal silicon by either thermal oxidation or deposition of a suitable insulator material (FIG. 1H). A mask layer 106 is next deposited onto the surface of insulator layer 105 (FIG. 1I) and subsequently exposed, developed, and patterned (FIG. 1J). Patterning of mask layer 106 selectively exposes surface area of underlying second insulator layer 105. An etch step is performed to remove insulator layer 105 material to the extent that a surface of underlying layer 104 of single-crystal silicon is selectively partially exposed (FIG. 1K). Subsequently, an emitter 107 is formed on the exposed surface of layer 104 of single-crystal silicon using methods commonly known in the art (FIG. 1L).

This results in an FED wherein emitter electrode 107 resides on layer 104 of single-crystal silicon rather than substrate 101. Layer 104 of single-crystal silicon may be completely electrically isolated from substrate 101 by performing a selective localized etch or selective localized oxidation of layer 104 of single-crystal silicon at the regions where layer 104 of single-crystal silicon passes through intervening insulator layer 102.

Figure 2A:
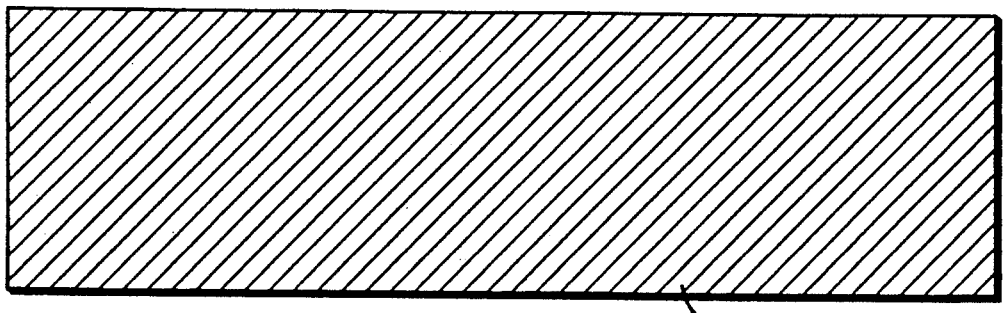
FIGS. 2A–G are a series of cross sectional depictions of structures resulting from steps that yield another embodiment of the invention.
Figure 2B:
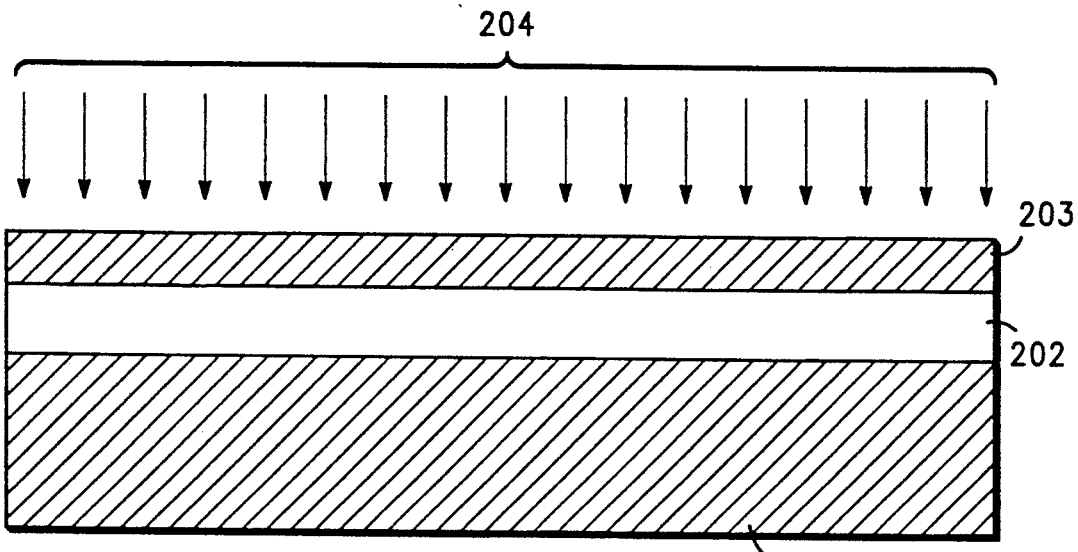
Figure 2C:
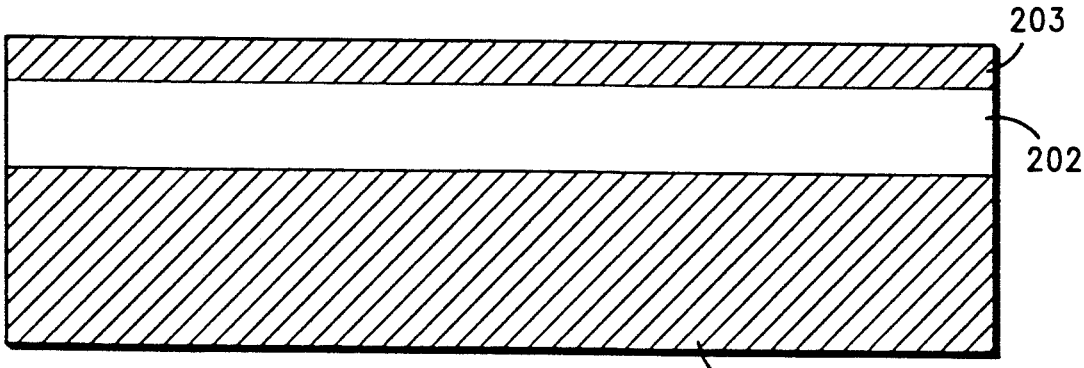
Figure 2D:
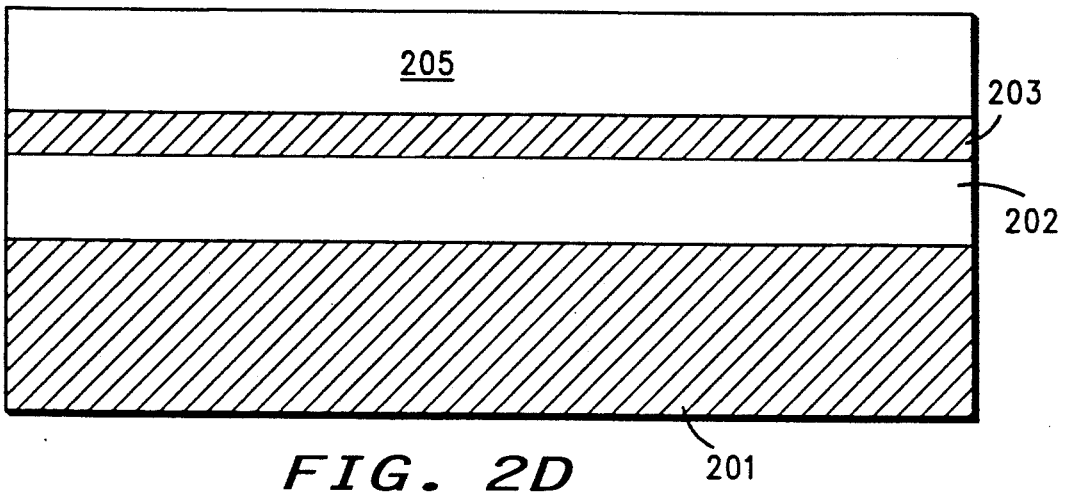
Figure 2E:
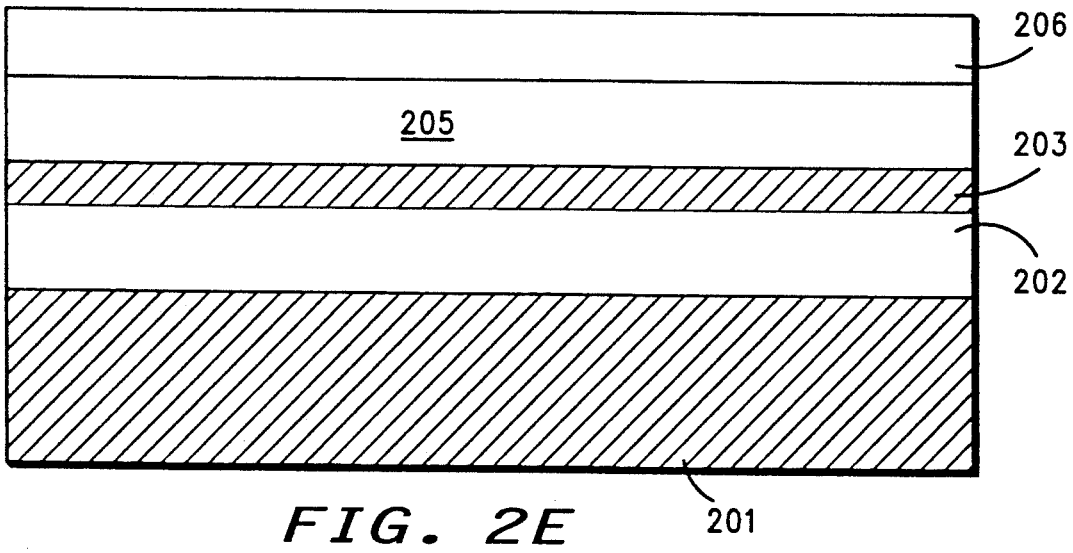
Figure 2F:
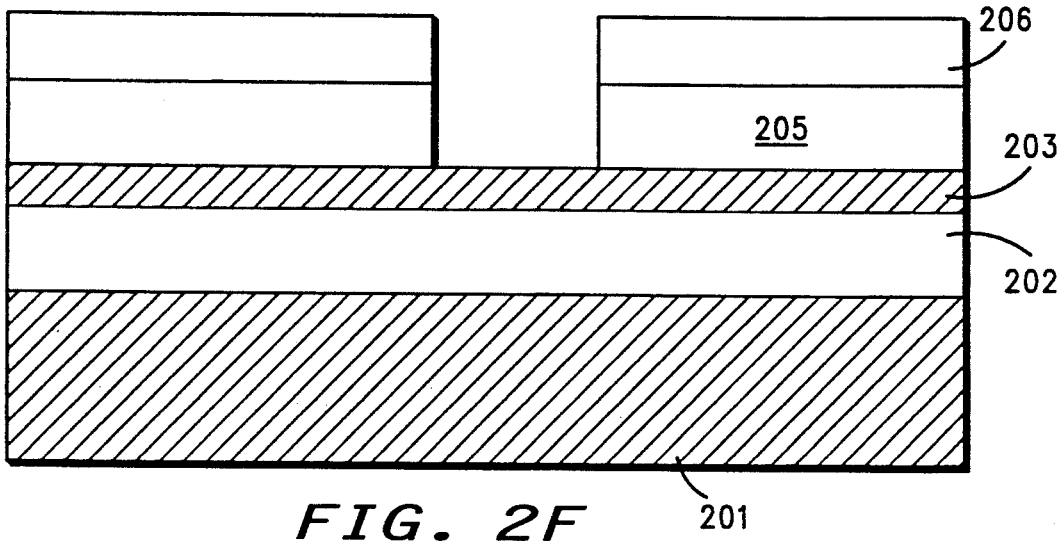
Figure 2G:
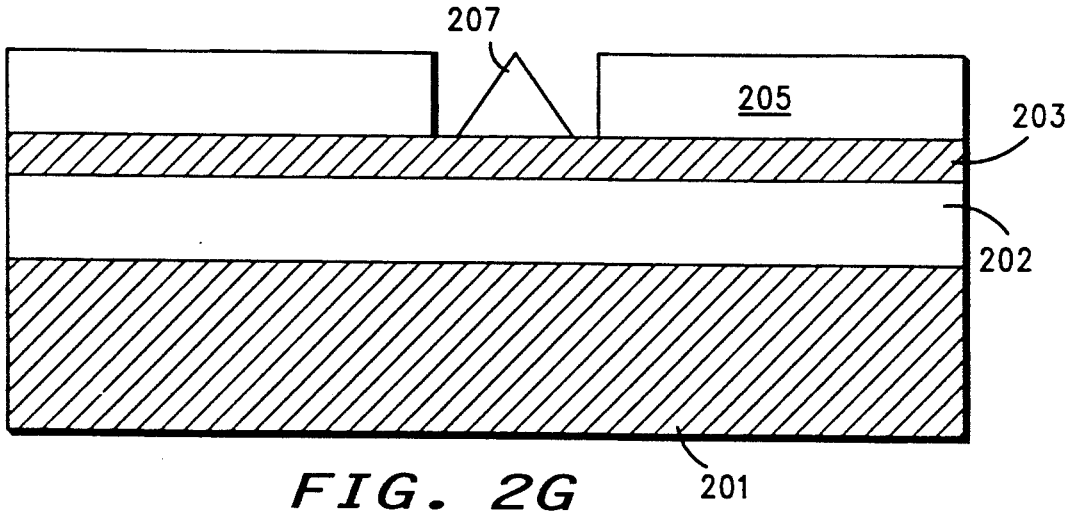

FIGS. 2A–2G depict a series of steps for realizing another embodiment of an FED. In FIG. 2A a substrate 201 is shown. An implantation of ions 204 into substrate 201 is performed with energy sufficient to result in an insulator layer 202 located beneath the surface of substrate 201 (FIG. 2B). This implantation results in a layer 203 of single-crystal silicon disposed on a surface of insulator layer 202 and electrically isolated from substrate 201. The implantation process results in lattice damage to layer 203 of single-crystal silicon which is repaired by annealing the layer 203 of single-crystal silicon to yield a reduced defect density in layer 203 of single-crystal silicon (FIG. 2C). Subsequently, the FED is formed as depicted in FIGS. 2D–2G and as described previously with reference to FIGS. 1H–1L. However, layer 203 of single-crystal silicon, in this embodiment, is effectively completely isolated from substrate 201 without the need for selective localized etch or selective localized oxidation.

Figure 3A:
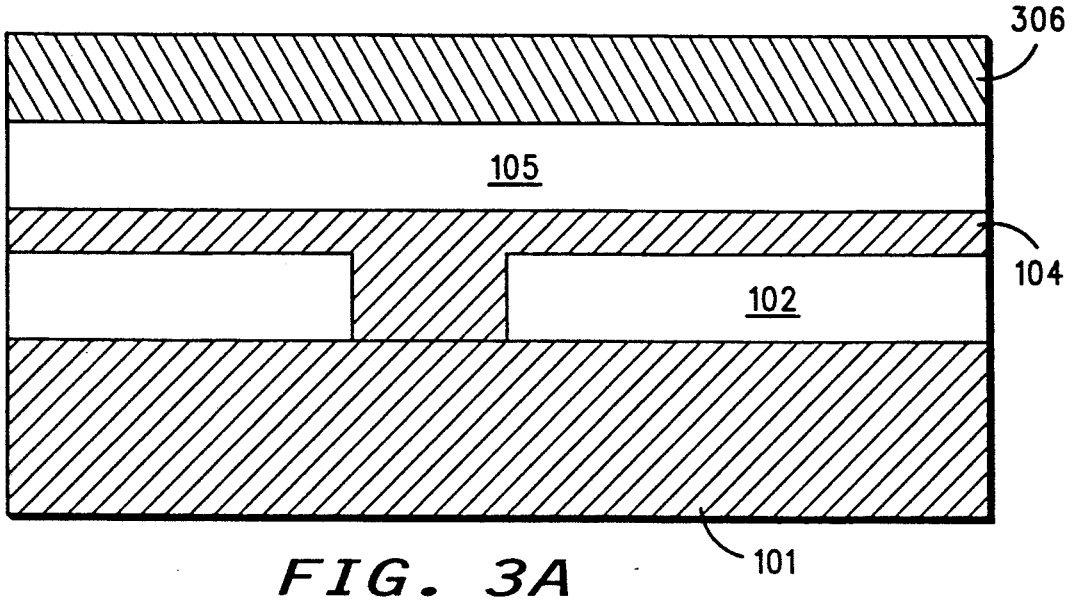
FIGS. 3A–3D are a series of cross sectional depictions of structures resulting from steps that yield another embodiment of the invention.
Figure 3B:
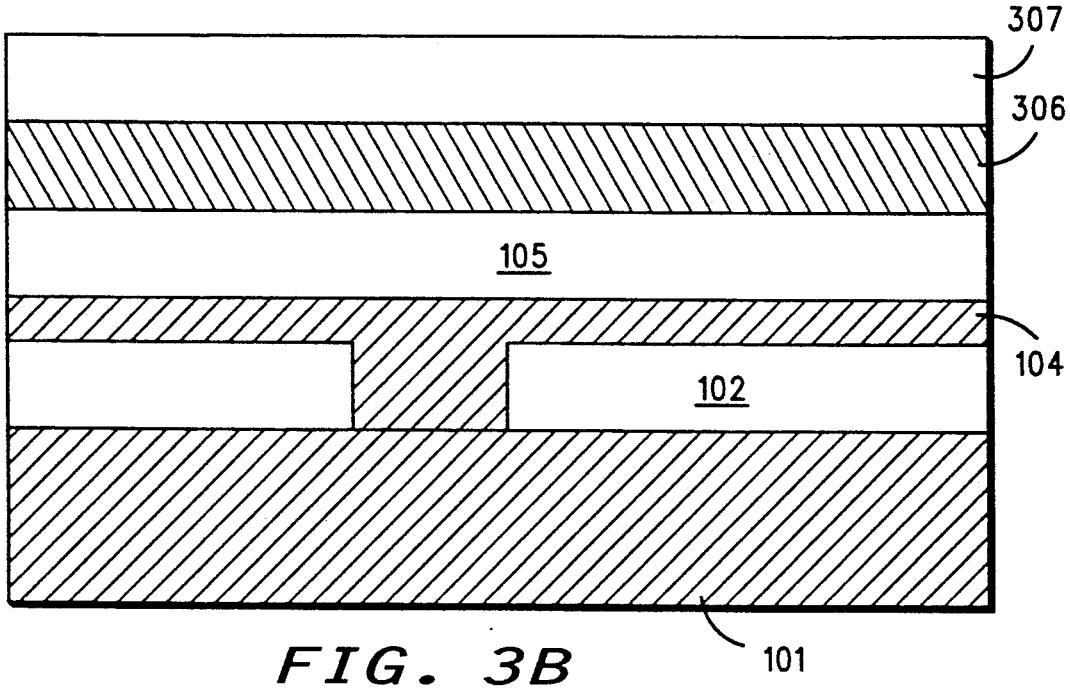
Figure 3C:
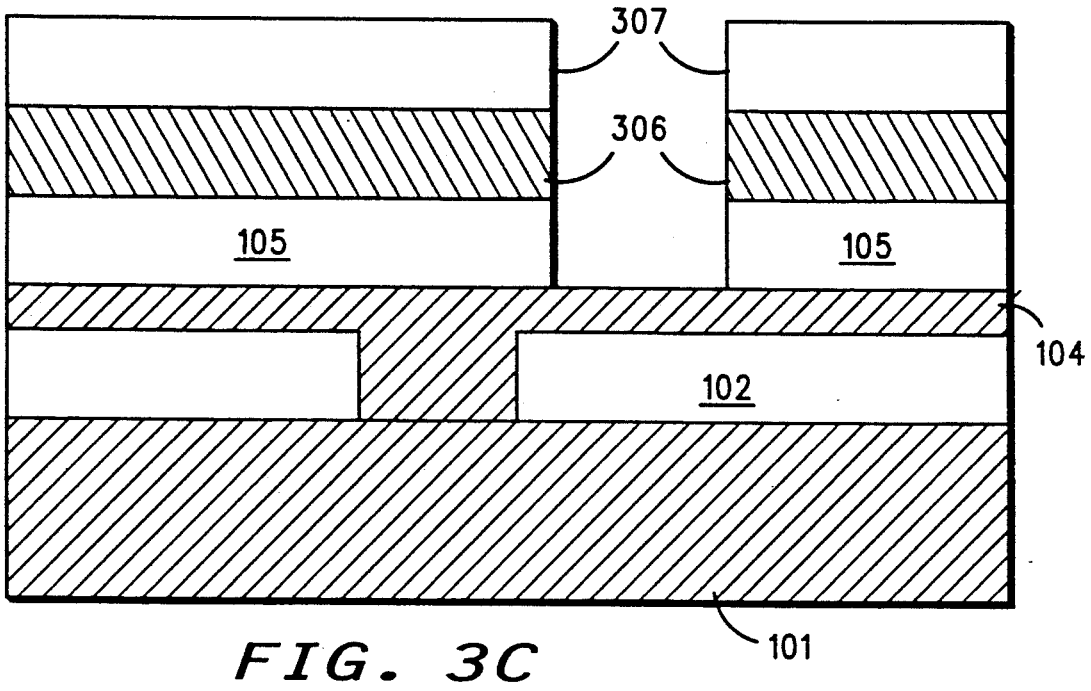
Figure 3D:
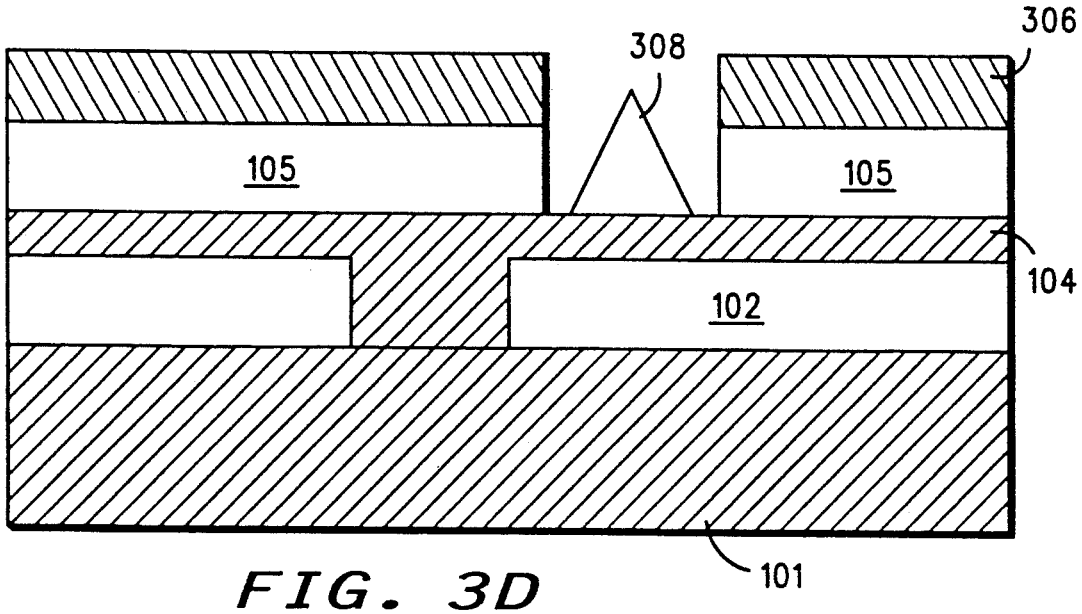

Another embodiment of the invention is realized by repeating the steps described above with respect to FIGS. 1A–1H. The realization continues with the deposition of a gate electrode 306 onto a surface of insulator layer 105 (FIG. 3A). This is followed by the deposition of a masking layer 307 onto a surface of gate electrode 306 (FIG. 3B). Mask layer 307 is then exposed, developed, and patterned and an etch step is performed to remove gate electrode 306 material and insulator layer 105 material to selectively expose a part of a surface of underlying layer 104 of single-crystal silicon (FIG. 3C). Subsequently, an emitter 308 is formed on the exposed surface of layer 104 of single-crystal silicon using methods commonly known in the art (FIG. 3D).

Figure 4A:
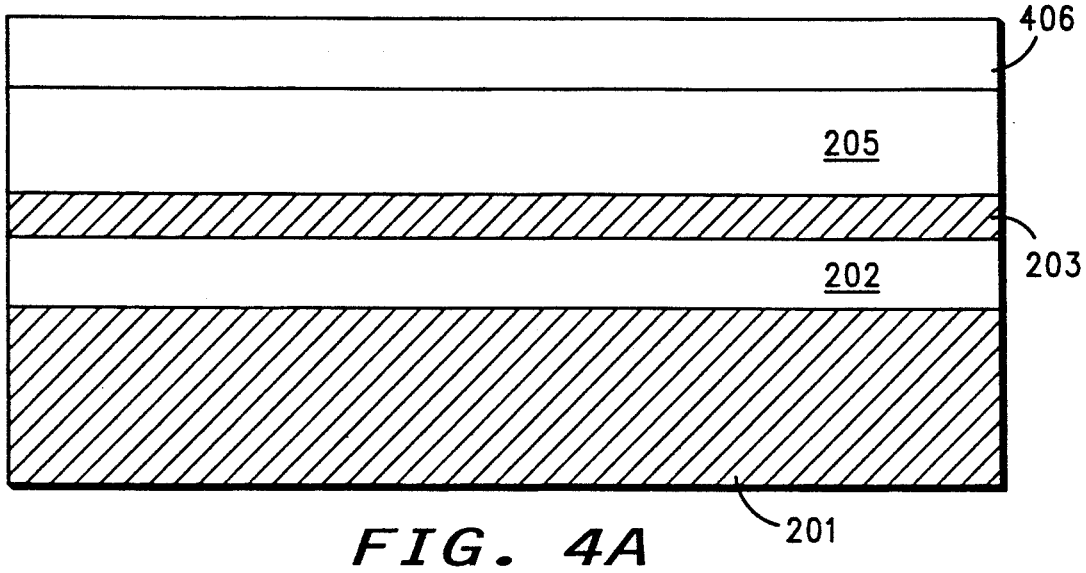
FIGS. 4A–4B are a series of cross sectional depictions of structures resulting from steps that yield another embodiment of the invention.
Figure 4B:
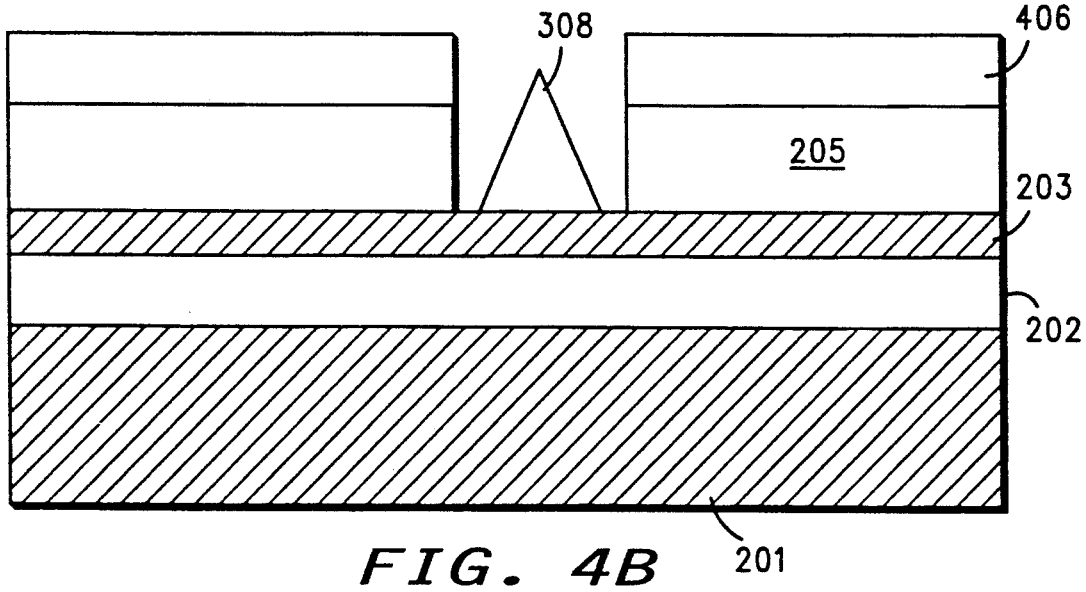

Another embodiment of the invention is realized by first repeating the steps described above with respect to FIGS. 2A–2D. This is followed by deposition of a gate electrode 406 onto a surface of insulator layer 205 (FIG. 4A). The realization of the device continues as described above with reference to FIGS. 3C and 3D to yield a resultant device as depicted in FIG. 4B having an emitter 308 disposed on layer 203 of single-crystal silicon.

Figure 5A:
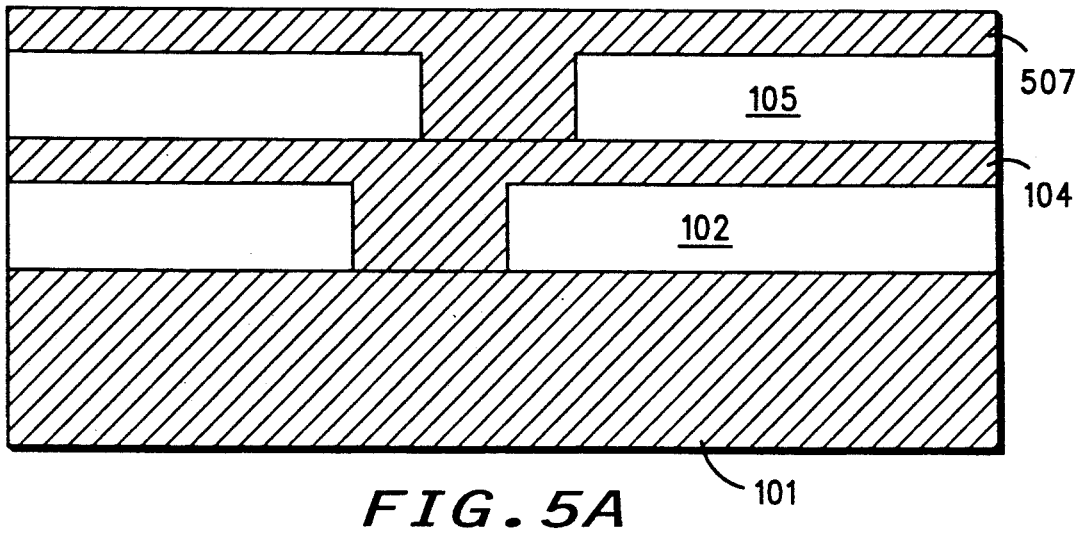
FIGS. 5A–5D are a series of cross sectional depictions of structures resulting from steps that yield another embodiment of the invention.
Figure 5B:
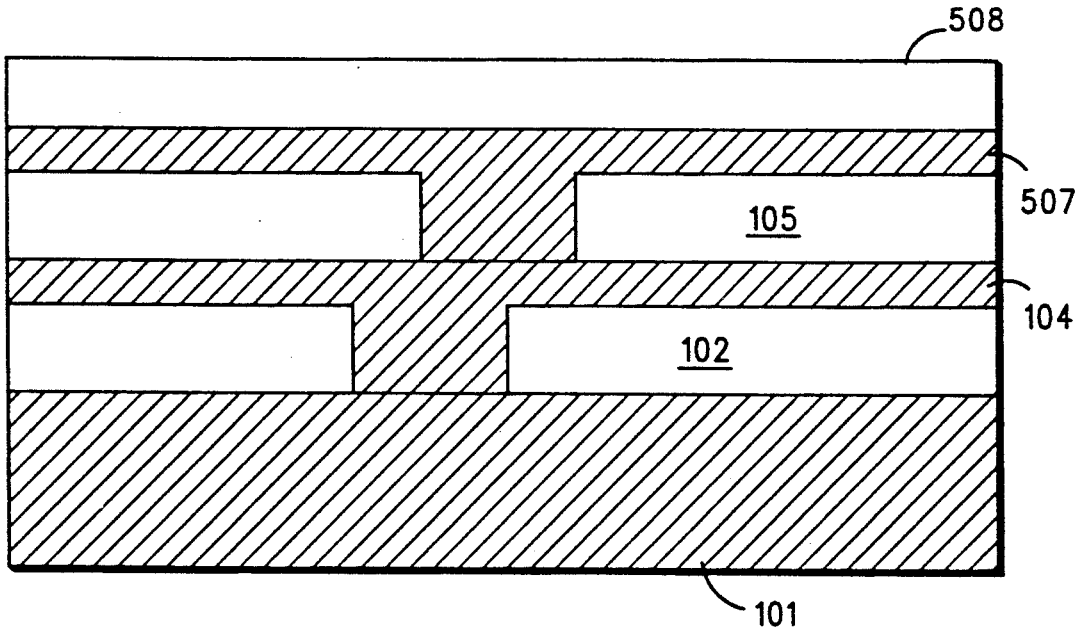
Figure 5C:
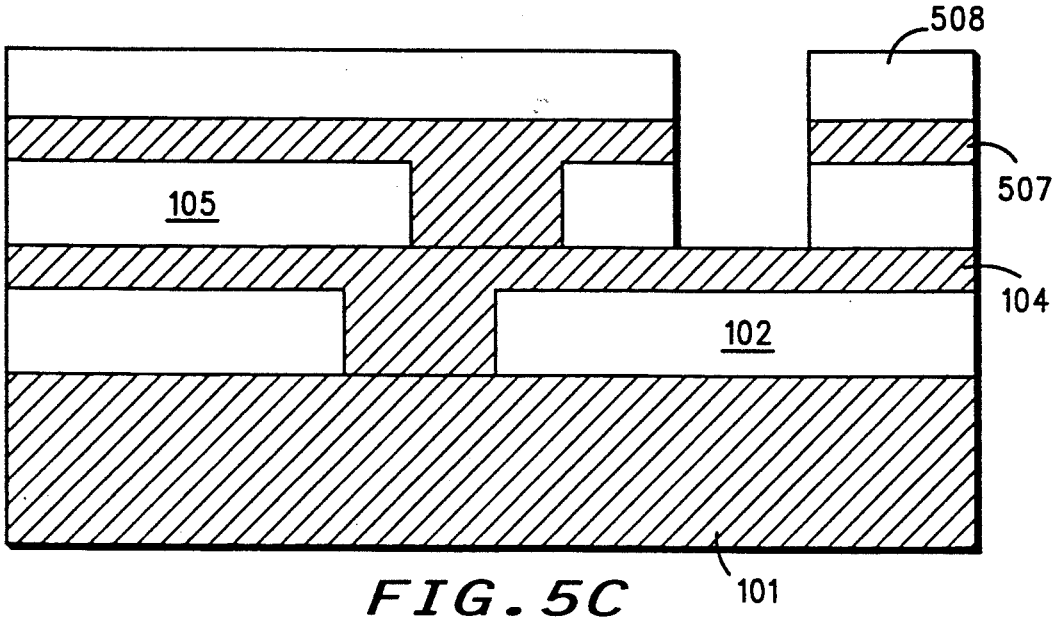
Figure 5D:
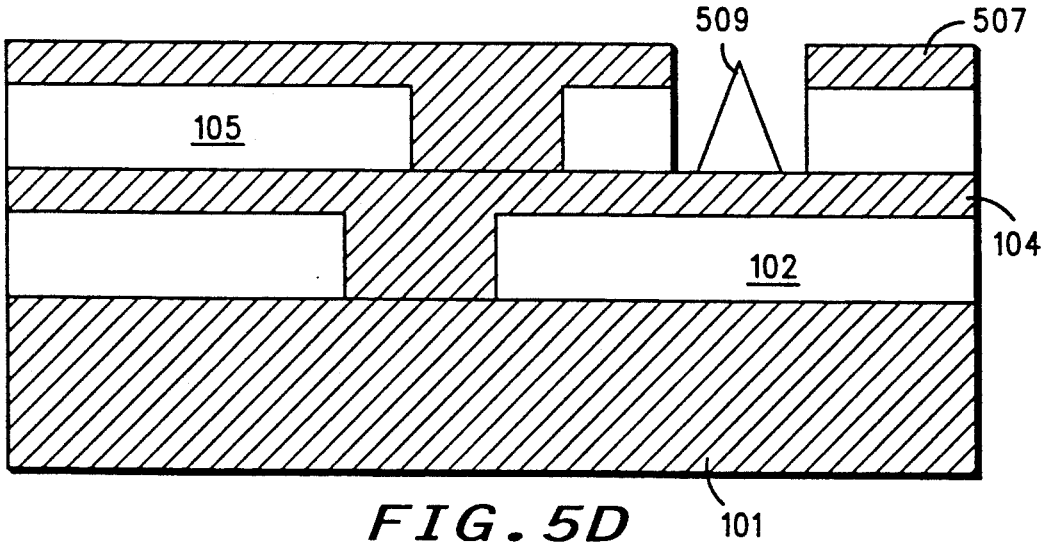

Another embodiment is realized as an FED having more than one layer of single-crystal silicon. The realization first proceeds as described above with reference to FIGS. 1A–1K. The structure is then placed in an environment wherein silicon preferentially precipitates onto the selectively exposed surface of an underlying first layer 104 of single-crystal silicon (FIG. 5A). A mask layer 508 is deposited onto a surface of second layer 507 of single-crystal silicon (FIG. 5B). Subsequent exposing, developing, and patterning of mask layer 508, etching of the selectively exposed portions of second layer 507 of single-crystal silicon, and etching of the selectively exposed portions of second insulator layer 105 selectively exposes a surface of first layer 104 of single-crystal silicon (FIG. 5C). Subsequently, an emitter 509 is formed on the exposed surface of first layer 104 of single-crystal silicon using methods commonly known in the art (FIG. 5D). It should be observed that each of the layers of single-crystal silicon is formed by selectively etching an insulator layer to expose the underlying material on which the insulator layer is disposed. By so doing, a structure of successive insulator layers and layers of single-crystal silicon are formed on a substrate.

Figure 6:
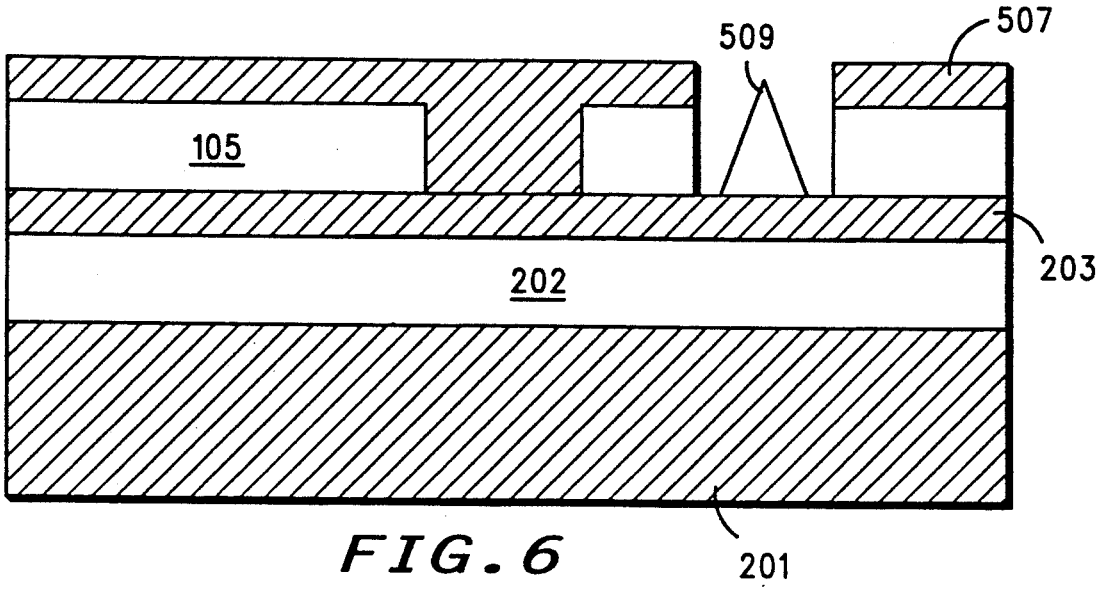
FIG. 6 is a cross sectional depiction of a structure which forms another embodiment of the invention.

Another embodiment of the invention is realized by first repeating the steps described above for FIGS. 2A–2C. The realization then continues as described above with reference to FIGS. 1H–1J and FIGS. 5A–5D. Second layer 507 of single-crystal silicon (FIG. 6) is effectively electrically isolated from first layer 203 of single-crystal silicon by performing a selective localized etch or selective localized oxidation of second layer 507 of single-crystal silicon at the locations where second layer 507 of single crystal silicon extends through insulator layer 105.

Figure 7A:
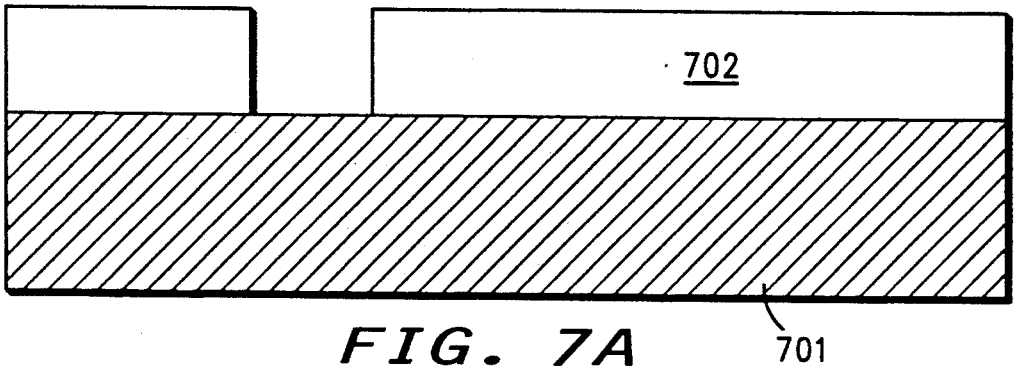
FIGS. 7A–7D are a series of cross sectional depictions of structures resulting from another method of forming a layer of single-crystal silicon.
Figure 7B:
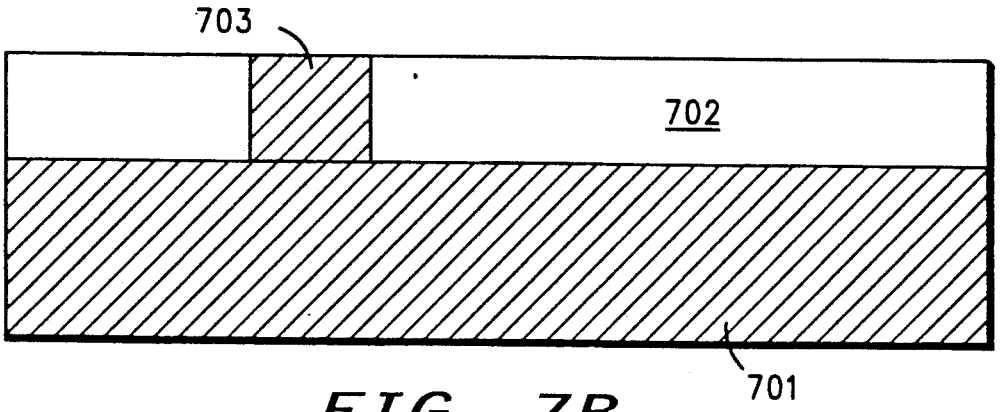
Figure 7C:
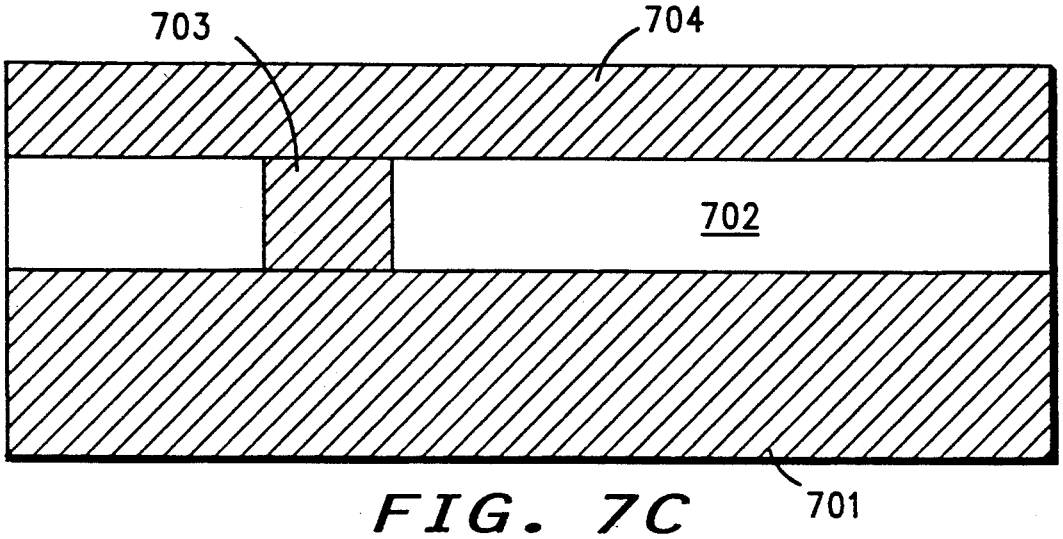
Figure 7D:
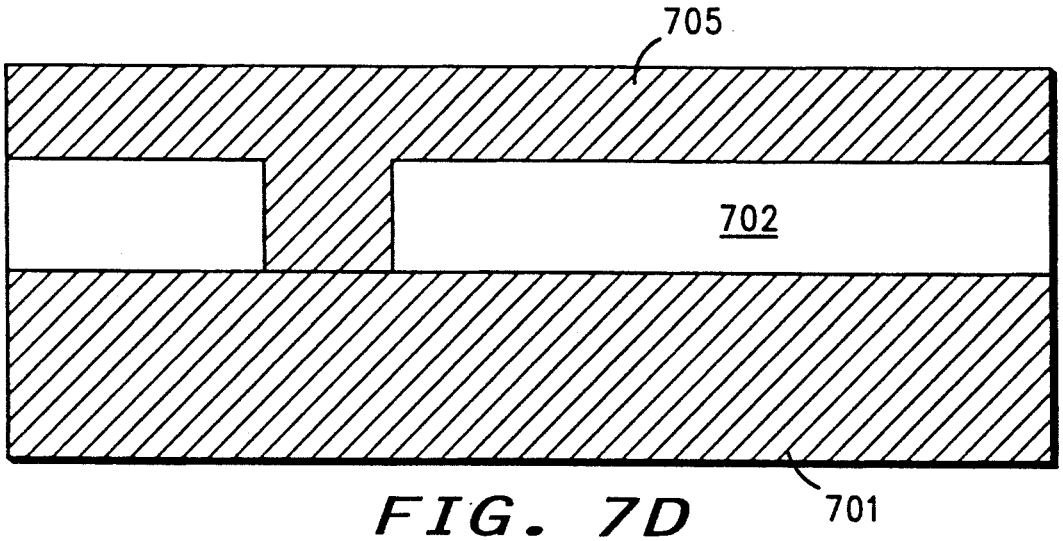

FIG. 7A depicts another embodiment of the invention realized with a substrate 701 on which is deposited an insulator layer 702 which has been selectively grown, selectively deposited, or etched to preferentially expose a part of a surface of underlying substrate 701. The structure is placed in an environment wherein silicon preferentially precipitates onto the partially exposed surface of substrate 701 to form a single-crystal silicon protrusion 703 which extends into the plane of insulator layer 702 and at least partially occupies the volume coincident with insulator layer 702 where insulator layer 702 has been selectively etched or selectively not grown or not deposited (FIG. 7B). Subsequently, a layer 704 of silicon is deposited onto a surface of insulator layer 702 and onto a surface of single-crystal silicon protrusion 703 (FIG. 7C). This is followed by recrystallization of silicon layer 704 to yield a layer of single-crystal silicon 705 (FIG. 7D). The recrystallization of silicon layer 704 is accomplished by any of the methods commonly known in the art including thermal annealing, and laser recrystallization, the purpose of which is to increase crystal grain size and re-orient the lattice of silicon layer 704 to correspond to that of the lattice of underlying layer 701 of single-crystal silicon.

Figure 8A:
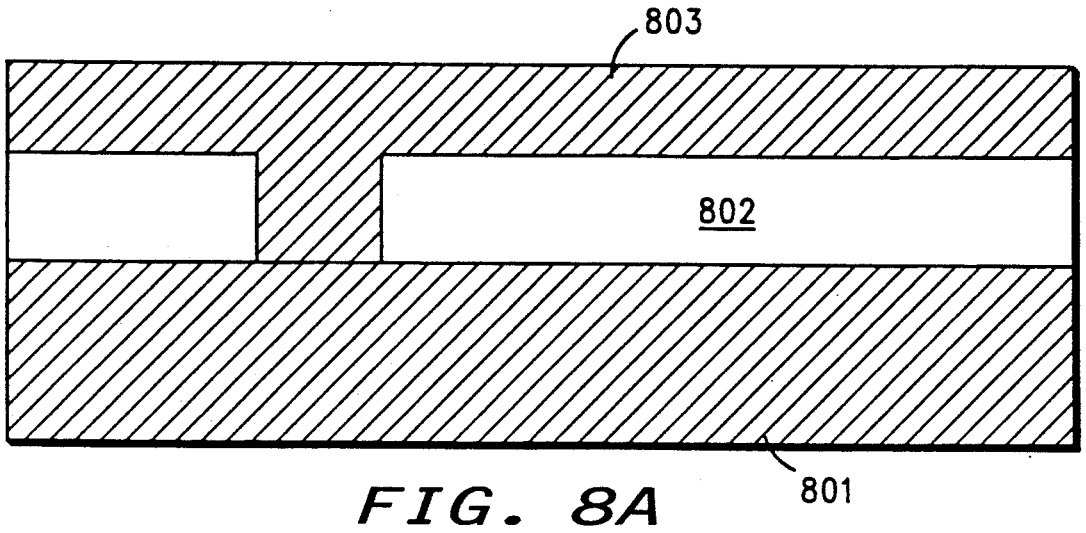
FIGS. 8A–8B are a series of cross sectional depictions of structures resulting from another method of forming a layer of single-crystal silicon.
Figure 8B:
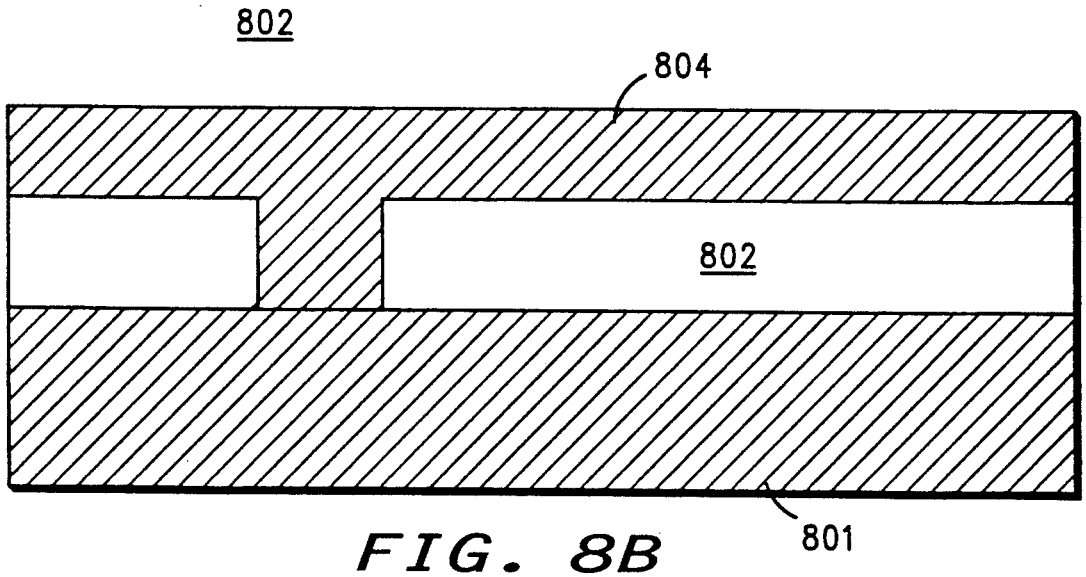

FIG. 8A depicts another embodiment of the invention wherein a layer of silicon 803 has been deposited onto a surface of an insulator 802 and onto the preferentially exposed parts of a surface of a substrate 801. A subsequent recrystallization yields a structure with a layer of single-crystal silicon 804 (FIG. 8B).

Figure 9A:
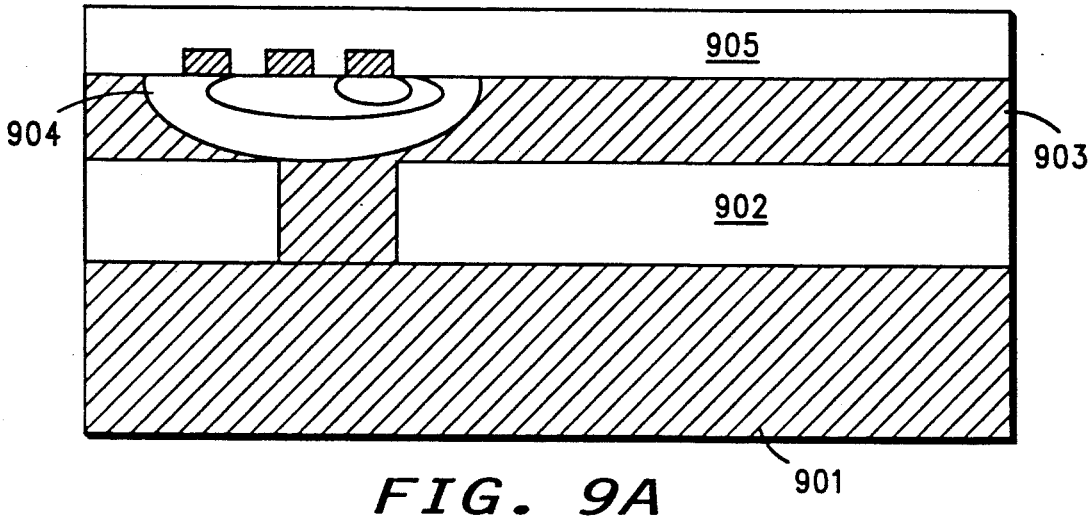
FIGS. 9A–9E are a series of cross sectional depictions of structures resulting from steps that yield another embodiment of the invention.
Figure 9B:
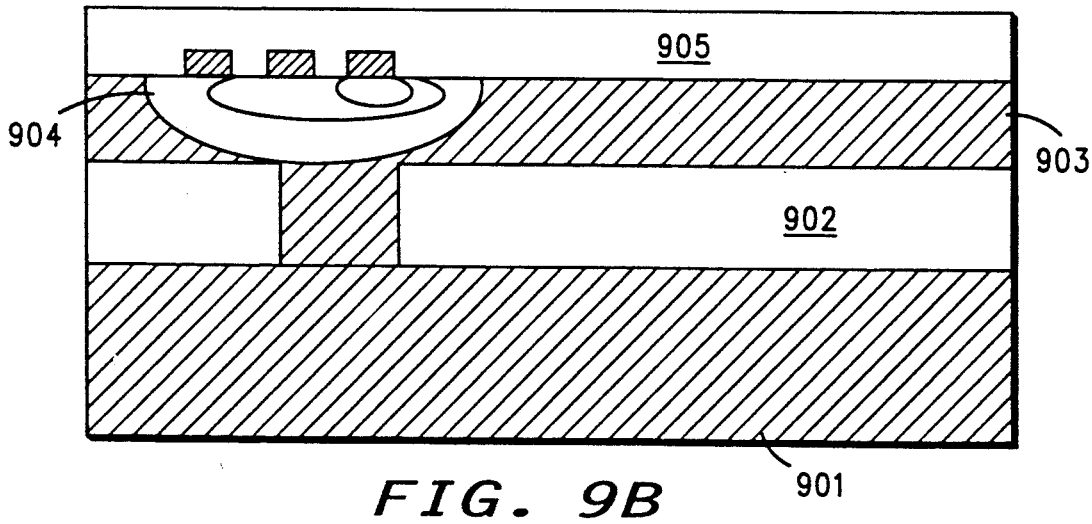
Figure 9C:
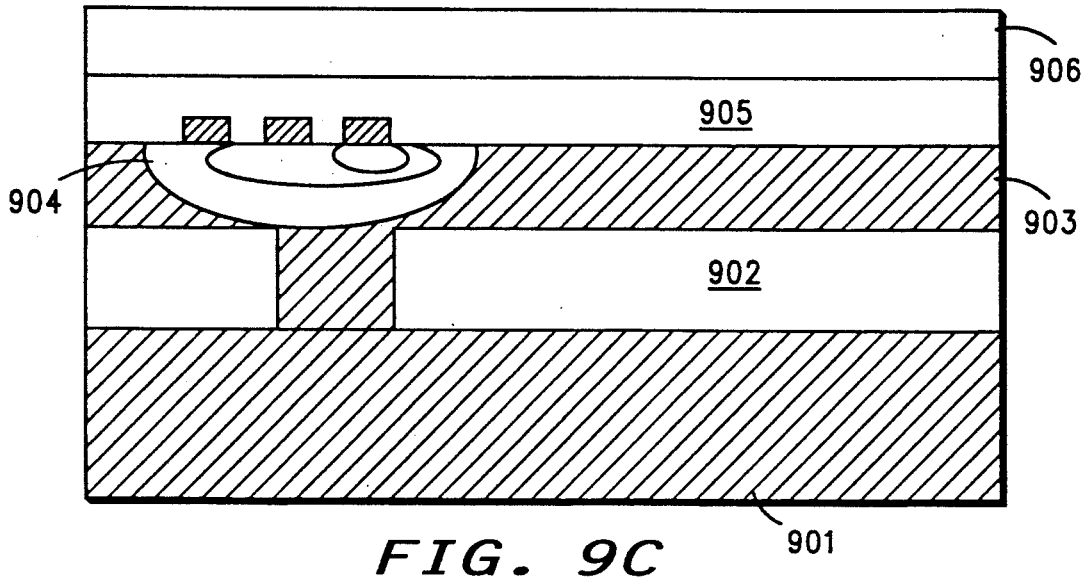
Figure 9D:
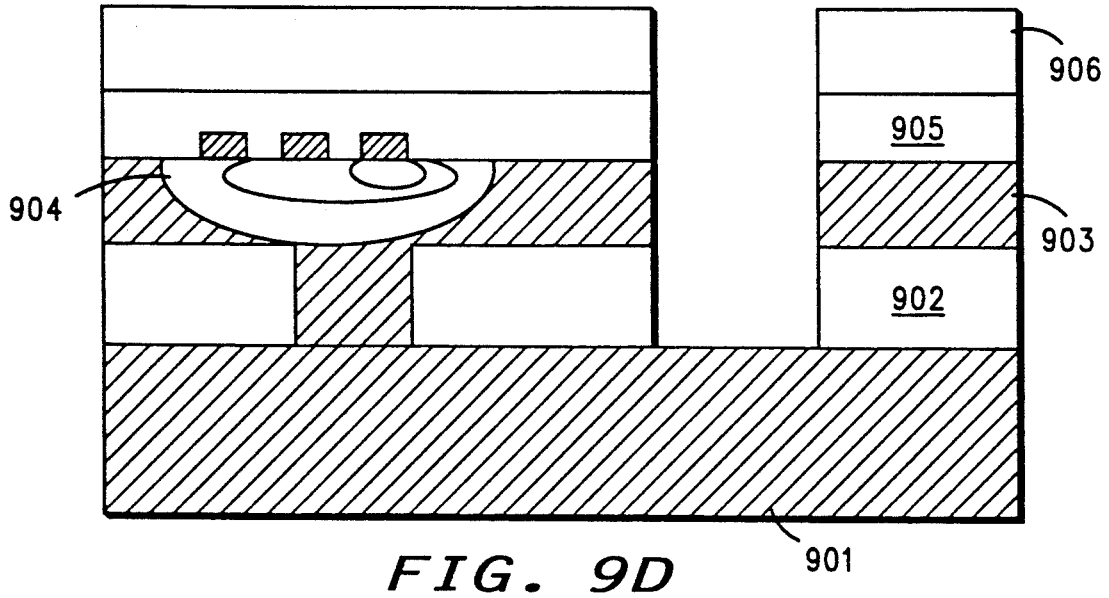
Figure 9E:
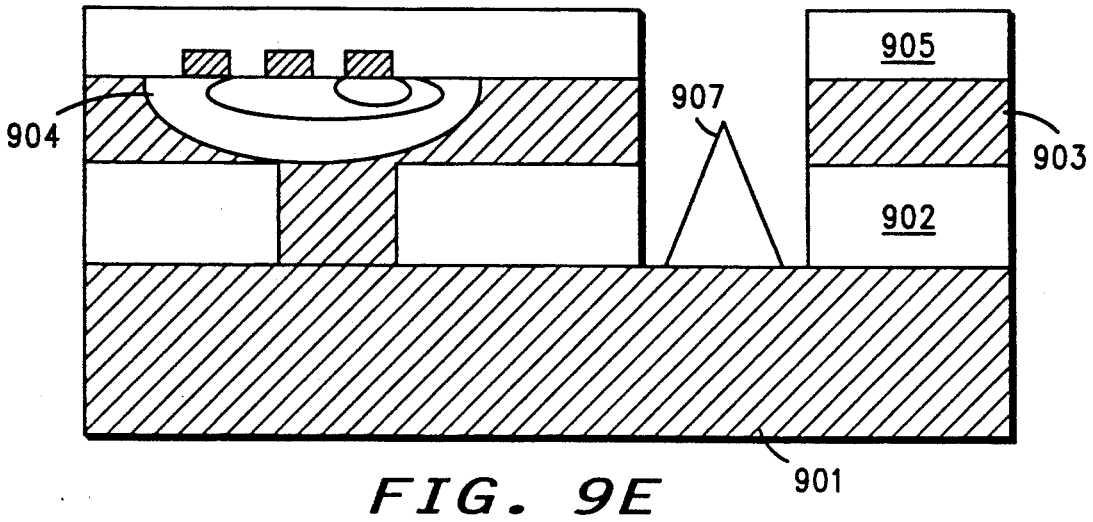

FIGS. 9A–9E depict a series of steps to realize another embodiment of the invention. The structure of FIG. 9A, formed by any of the methods described above, has diffused in a layer 903 of single-crystal silicon a bipolar transistor 904. An insulator layer 905 is deposited onto a surface of layer 903 of single-crystal silicon and effectively covering bipolar transistor 904. (FIG. 9B). A mask layer 906 is then deposited onto a surface of insulator layer 905 (FIG. 9C). Subsequent selective exposing, developing, and patterning of mask layer 906 and selectively etching insulator layer 905, layer 903 of single-crystal silicon, and insulator layer 902, selectively exposes a part of a surface of substrate 901 (FIG. 9D). An emitter 907 is then formed on the exposed surface of substrate 901 using methods commonly known in the art (FIG. 9E). The device so constructed provides for incorporating bipolar transistor device 904 formed in layer 903 of single-crystal silicon, which layer is not substrate 901, and which bipolar transistor device 904 resides in close proximity to and as part of the same structure as the FED.

Figure 10:
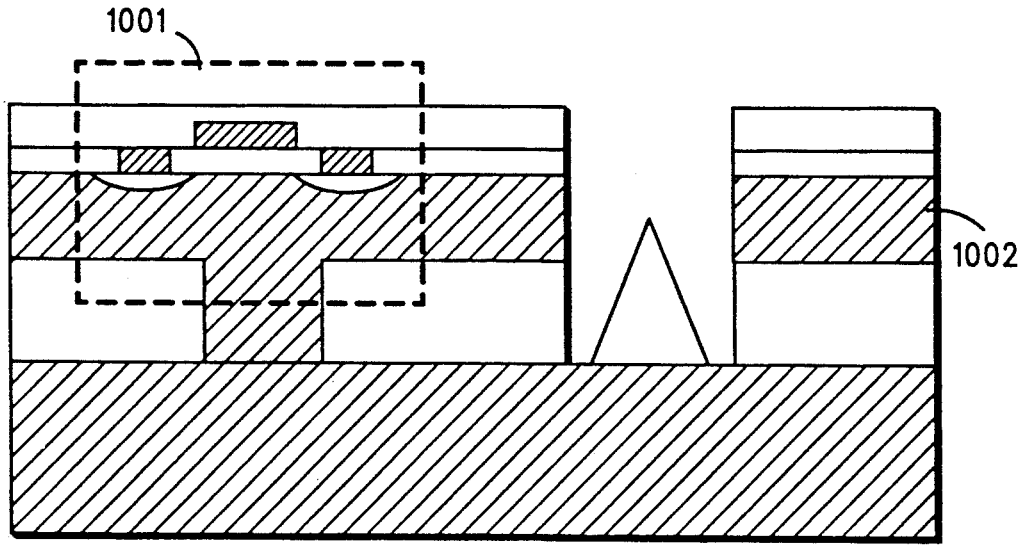
FIG. 10 is a cross sectional view depicting another embodiment of the invention.

FIG. 10 depicts another embodiment of the invention which employs a field-effect transistor 1001 which resides at least partially within a layer 1002 of single-crystal silicon. The device so constructed provides for incorporating field-effect transistor device 1001 formed in a layer 1002 of single-crystal silicon, which layer 1002 of single-crystal silicon is not the substrate and which field-effect transistor device 1001 resides in close proximity to and as part of the same structure as the FED.

Figure 11:
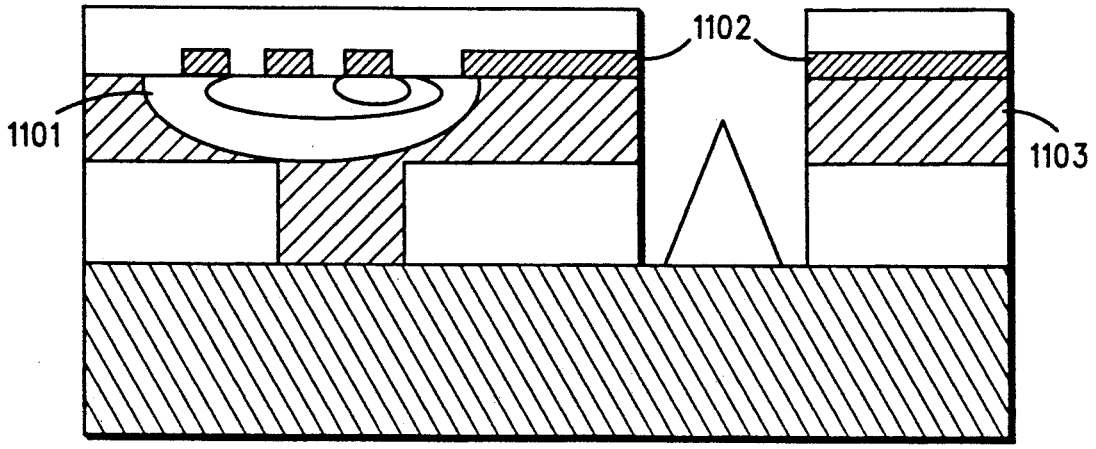
FIG. 11 is a cross sectional view depicting another embodiment of the invention.

FIG. 11 depicts another embodiment of the invention employing a bipolar transistor device 1101 formed in a layer 1103 of single-crystal silicon and having an FED gate electrode 1102 disposed on layer 1103 of single-crystal silicon and operably coupled to the collector of bipolar transistor device 1101.

Figure 12:
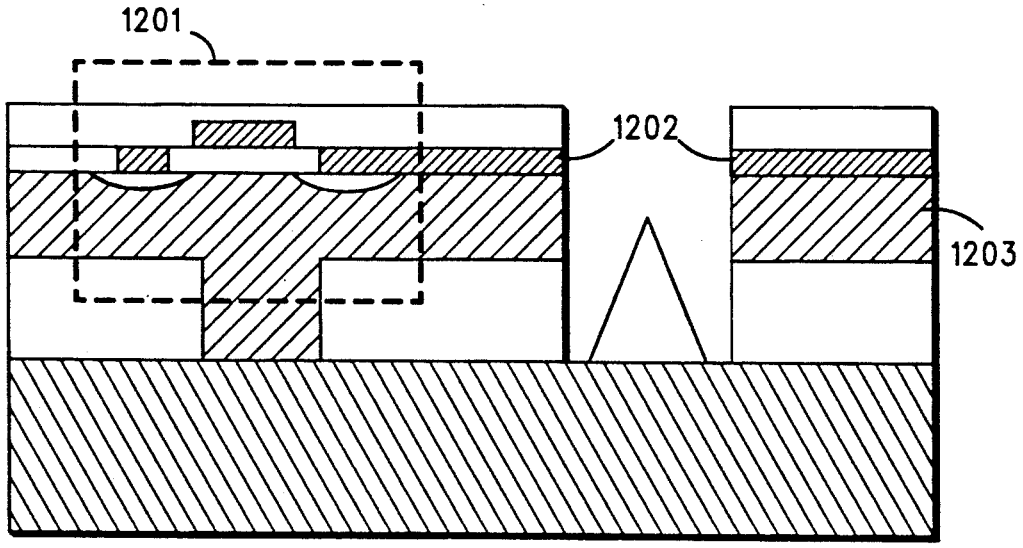
FIG. 12 is a cross sectional view depicting another embodiment of the invention.

FIG. 12 depicts another embodiment of the invention employing a field-effect transistor device 1201 formed in a layer 1203 of single-crystal silicon and having an FED gate electrode 1202 disposed on layer 1203 of single-crystal silicon and operably coupled to the drain of field-effect transistor device 1201.

Figure 13:
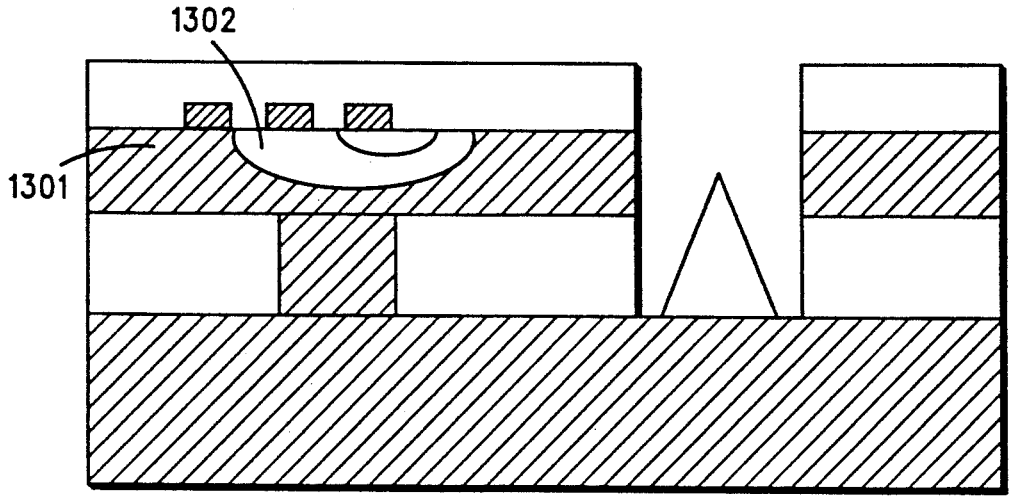
FIG. 13 is a cross sectional view depicting another embodiment of the invention.

FIG. 13 depicts another embodiment of the invention employing a bipolar transistor device 1302 disposed in a layer 1301 of single-crystal silicon, which layer 1301 of single-crystal silicon has been doped with impurities. Layer 1301 of single-crystal silicon, so formed, functions as both the collector of bipolar transistor device 1302 and as a FED gate electrode.

Figure 14:
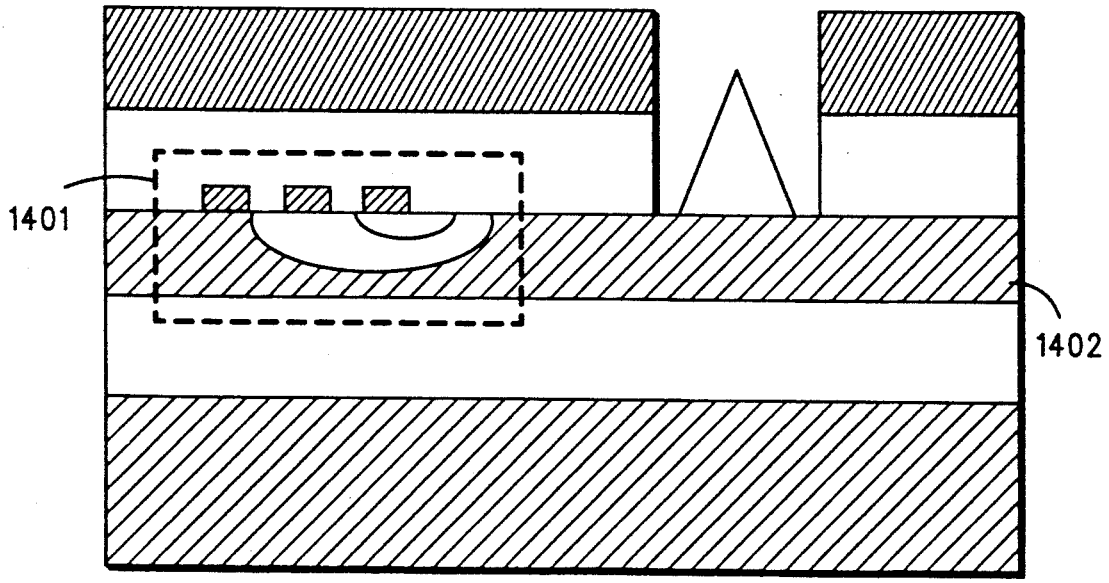
FIG. 14 is a cross sectional view depicting another embodiment of the invention.

FIG. 14 depicts another embodiment of the invention employing a field-effect transistor device 1401 disposed in a layer 1402 of single-crystal silicon, which layer 1402 of single-crystal silicon has been doped with impurities. Layer 1402 of single-crystal silicon, so formed, functions as both the drain of field-effect transistor device 1401 and as a FED gate electrode.

Figure 15:
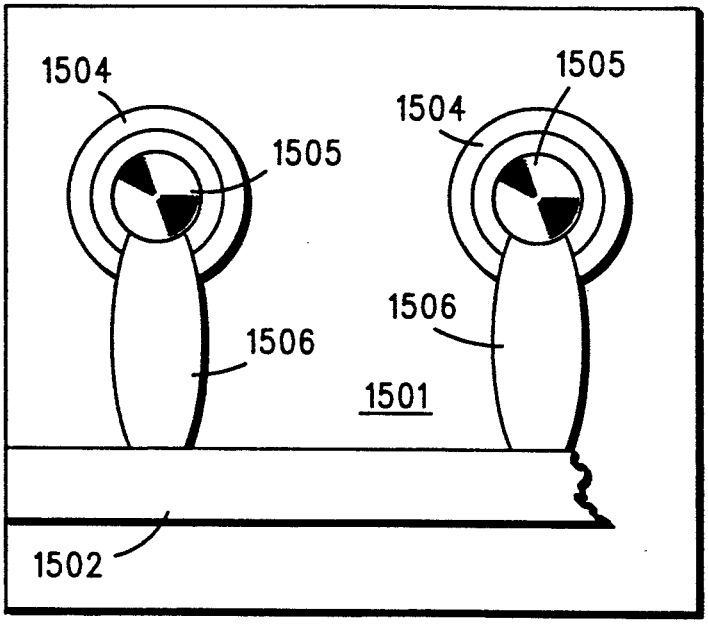
FIG. 15 is a top plan view depicting a plurality of field emission devices employing a preferentially doped layer of single-crystal silicon.

FIG. 15 is a partial top plan depiction of an embodiment of a device 1500 employing a plurality of FEDs which have been selectively electrically interconnected. In this embodiment, apertures, in which emitters 1505 are formed, are substantially peripherally individually surrounded by selectively, geometrically shaped gate electrodes 1504. Emitters 1505 are electrically connected to selectively doped resistive regions 1506, which selectively doped resistive regions 1506 are disposed in a layer 1501 of single-crystal silicon and operably coupled to a selectively doped high-conductive stripe 1502. Selectively doped high-conductive stripe 1502 is also disposed in layer 1501 of single-crystal silicon. So constructed, device 1500 functions with independently controlled electron emission at each emitter 1505.

Figure 16:
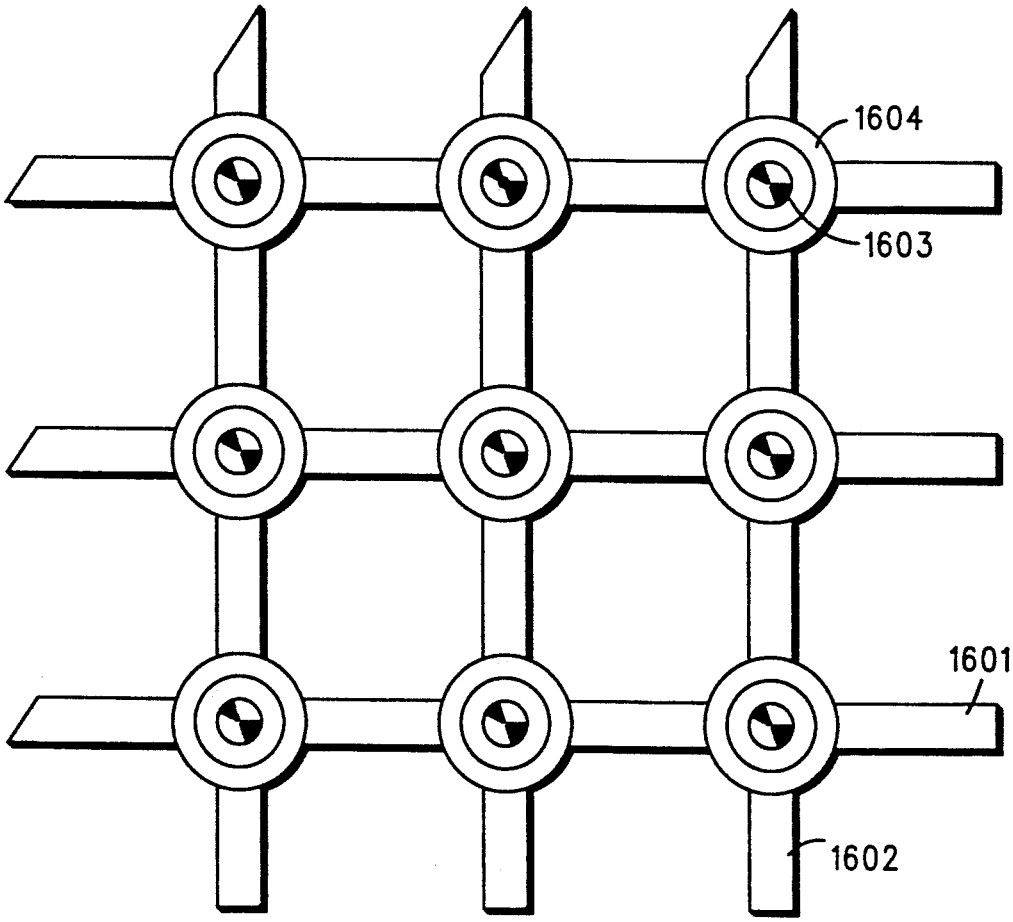
FIG. 16 is a top plan view of a plurality of field emission devices employing a plurality of selectively doped layers of single-crystal silicon.

FIG. 16 is a top plan depiction which illustrates a means of selectively electrically interconnecting the various electrodes of a multiplicity of FEDs of a device 1600 to obtain row and column addressing capability. In this embodiment, emitters 1603 are selectively operably connected to a selectively doped high-conductive stripe 1602 in a columnar manner such that emitters 1603 are electrically isolated from emitters 1603 not in the same column. Selectively geometrically patterned gate electrodes 1604 are electrically operably connected to high-conductive stripes 1601, which high-conductive stripes 1601 may be formed as a deposition of conductive or semiconductor material, or as a selectively doped region of a layer of single-crystal silicon. So constructed, device 1600 provides for a means of exercising row and column addressing of individual FEDs of the plurality of FEDs in device 1600.

Figure 17:
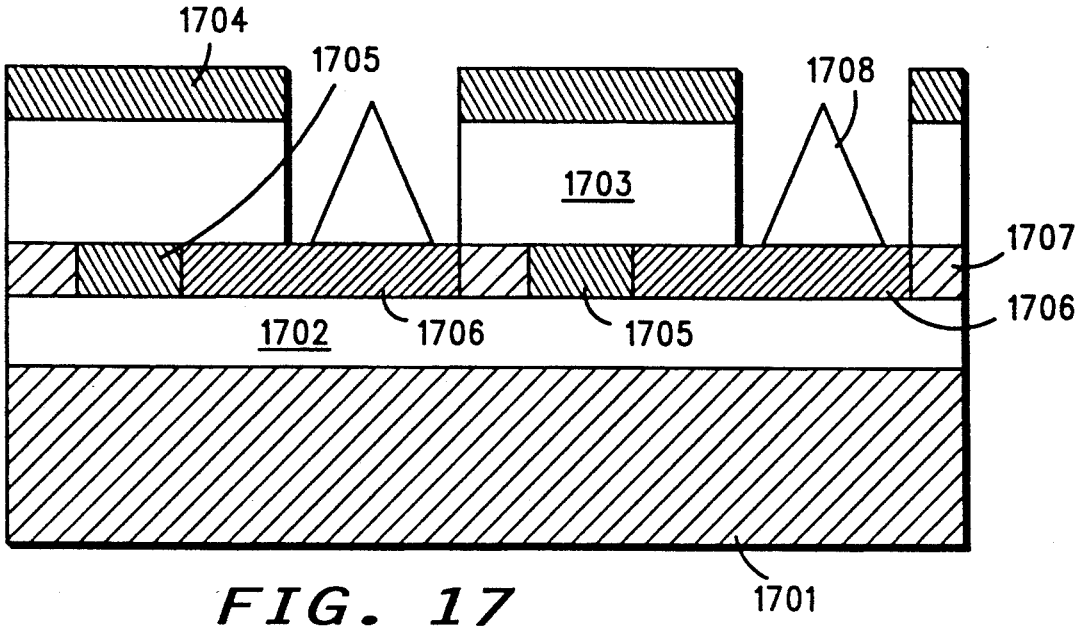
FIG. 17 is a cross sectional view depicting an embodiment of a plurality of field emission devices.

FIG. 17 depicts, in cross-sectional view of a selectively operably interconnected plurality of FEDs employing selectively doped resistive regions 1706. In this embodiment, columns of emitters 1708 are individually operably connected and disposed on individual selectively doped resistive regions 1706, which selectively doped resistive regions 1706 are disposed in a layer 1707 of single-crystal silicon. Selectively doped resistive regions 1706 are operably connected to selectively doped high-conductive stripes 1705, which selectively doped high-conductive stripes 1705 are also disposed in layer 1707 of single-crystal silicon. A plurality of FEDs constructed in accordance with this embodiment have provided a means for independent columnar control of columns of emitters 1708 and independent limitation of electron emission from each of the plurality of emitters 1708.

Figure 18:
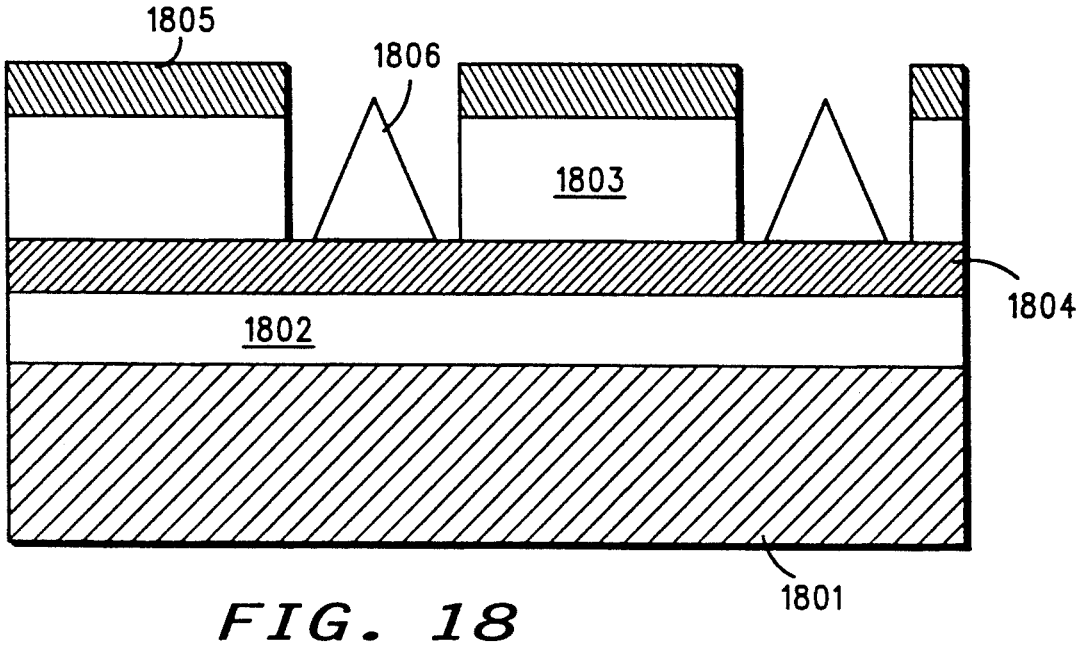
FIG. 18 is a cross sectional view depicting another embodiment of a plurality of field emission devices.

FIG. 18 is a cross-sectional view of a plurality of FEDs in accordance with another embodiment of the invention. A plurality of emitters 1806 are disposed on a substantially uniformly doped layer 1804 of single-crystal silicon. Uniformly doped layer 1804 of single-crystal silicon is implanted with impurities by any of the known methods of semiconductor doping to provide that uniformly doped layer 1804 of single-crystal silicon functions as a distributed resistive element to effectively limit the electron emission from each of the plurality of emitters 1806 in an independent manner.

It will be immediately obvious to those skilled in the art and familiar with the known configurations of FEDs that emitters may be formed in shapes other than the depicted conical shape. Some other emitter shapes include wedges of varying lengths and being either straight or serpentine. For such emitter configurations, the associated aperture will be non-circularly cylindrical and will conform substantially symmetrically to the elongated shape of the emitter. Further, the methods described may be extended to provide field emission devices with more than two layers of single-crystal silicon and/or more than a single electrode in addition to the emitter. Such field emission devices will typically take the form of tetrode or pentode devices commonly known and described in the literature.

What I claim is:

1. An electronic device comprising:

a substrate;

an insulator layer disposed on a surface of the substrate;

a layer of single-crystal silicon disposed on a surface of the insulator layer;

an opening formed through the layer of single-crystal silicon and the insulator layer and providing an exposed area of the surface of the substrate;

a field emission device including an emitter disposed on the exposed area of the surface of the substrate within the opening and a gate electrode disposed on a surface of the layer of single-crystal silicon; and a transistor device disposed at least partially in the layer of single crystal silicon and operably coupled to the gate electrode of the field emission device.

2. An electronic device as claimed in claim 1 wherein the layer of single-crystal silicon is doped with impurities and functions as an electrode of the transistor device and the gate electrode of the field emission device.

3. An electronic device comprising:

a substrate;

a first insulator layer disposed on a surface of the substrate;

a first layer of single-crystal silicon disposed on a surface of the insulator layer;

a second insulator layer disposed on a surface of the first layer of single-crystal silicon;

a second layer of single-crystal silicon disposed on a surface of the second insulator layer;

an opening formed through the second layer of single-crystal silicon and the second insulator layer and providing an exposed area of the surface of the first layer of single-crystal silicon;

a field emission device including an emitter disposed on the exposed area of the surface of the first layer of single-crystal silicon within the opening and a gate electrode disposed on a surface of the second layer of single-crystal silicon; and a transistor device disposed at least partially in one of the first layer of single crystal silicon and the second layer of single crystal silicon and operably coupled to one of the emitter and the gate electrode of the field emission device.

4. An electronic device as claimed in claim 3 wherein the second layer of single-crystal silicon is doped with impurities and functions as the gate electrode of the field emission device.

* * * * *